US009310756B2

(12) United States Patent
Koishi et al.

(10) Patent No.: US 9,310,756 B2
(45) Date of Patent: Apr. 12, 2016

(54) IMAGE FORMING APPARATUS AND MAIN ASSEMBLY OF THE IMAGE FORMING APPARATUS

(71) Applicant: CANON KABUSHIKI KAISHA, Tokyo (JP)

(72) Inventors: Isao Koishi, Yokohama (JP); Yu Fukasawa, Nagareyama (JP); Ryoji Kusudo, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/582,421

(22) Filed: Dec. 24, 2014

(65) Prior Publication Data

US 2015/0185688 A1 Jul. 2, 2015

(30) Foreign Application Priority Data

Dec. 26, 2013 (JP) ..... 2013-269057

(51) Int. Cl.
*G03G 21/16* (2006.01)
*G03G 21/18* (2006.01)

(52) U.S. Cl.
CPC ..... *G03G 21/1661* (2013.01); *G03G 21/1633* (2013.01); *G03G 21/1853* (2013.01)

(58) Field of Classification Search
CPC ..... G03G 21/1661; G03G 21/1619; G03G 21/1633; G03G 2221/1884; G03G 21/1842
See application file for complete search history.

(56) References Cited

U.S. PATENT DOCUMENTS

2007/0242977 A1* 10/2007 Suzuki ..... 399/113
2009/0317128 A1* 12/2009 Jang ..... 399/110
2014/0161489 A1 6/2014 Niikawa et al.
2015/0055976 A1* 2/2015 Murakami et al. ..... 399/110

FOREIGN PATENT DOCUMENTS

JP H11-249363 A 9/1999

* cited by examiner

*Primary Examiner* — Rodney Bonnette
(74) *Attorney, Agent, or Firm* — Fitzpatrick, Cella, Harper & Scinto

(57) ABSTRACT

An image forming apparatus includes a main assembly provided with an opening through which a cartridge is to be mounted, an openable member movable between a closed position and an open position, and a cartridge, including a portion-to-be-urged, detachably mountable to the main assembly in a mounting completion position. When the openable member is open, a supporting surface is capable of guiding the cartridge to the opening, and during a closing operation, an urging portion and the portion-to-be-urged contact each other to push the cartridge toward the mounting completion position. When the openable member is in the closed position, a spacing is provided between the recessed portion and the portion-to-be-urged. The cartridge is a process cartridge having a photosensitive member unit and a developing device unit including the portion-to-be-urged.

16 Claims, 17 Drawing Sheets

(a)

(b)

IMAGE FORMING APPARATUS AND MAIN ASSEMBLY OF THE IMAGE FORMING APPARATUS

FIELD OF THE INVENTION AND RELATED ART

The present invention relates to an image forming apparatus and a main assembly of the image forming apparatus.

Here, the image forming apparatus is an apparatus for forming an image on a recording material by using known various image forming principles or types, such as an electrophotographic process, an electrostatic recording process and magnetic recording process. Examples of the image forming apparatus may include a copying machine, a printer (laser printer, LED printer or the like), a facsimile apparatus, a word processor, and an image display apparatus (electronic blackboard or electronic white board).

The recording material is a material on which the image is to be formed, and includes, e.g., paper (sheet), an OHP sheet, a secondary transfer member and so on.

A cartridge is prepared by integrally assembling a part or all of an image forming portion including an image bearing member on which an image is to be formed and an image forming process means actable on the image bearing member, into a unit. Further, the process cartridge is detachably mounted into the main assembly of the image forming apparatus and contributes to the image forming process for forming the image on the recording material. The main assembly of the image forming apparatus constituent portion excluding the cartridge in the image forming apparatus of a cartridge type.

Examples of the image bearing member may include an electrophotographic photosensitive member in the electrophotographic process, an electrostatic recording dielectric member in the electrostatic recording process, a magnetic recording (magnetic) material in the magnetic recording process, and members capable of forming images by other various image forming principles or types. The image forming process means is an image forming process means or device for forming the image by acting on the image bearing member.

In the following, for convenience, description will be made by taking the electrophotographic image forming as an example. As the cartridge, e.g., a process cartridge, a developing cartridge and a toner cartridge may be used.

The process cartridge is prepared by integrally assembling at least one of a charging means, a developing means and a cleaning means as electrophotographic process means, and an electrophotographic photosensitive member as an image bearing member into a unit (cartridge), and then is detachably mounted into the main assembly of the electrophotographic image forming apparatus. The main assembly of the electrophotographic photosensitive member is an electrophotographic image forming apparatus portion from which the cartridge is removed. This main assembly is hereinafter also referred to as an apparatus main assembly.

Accordingly, the process cartridge also includes a cartridge which is prepared by integrally assembling the electrophotographic photosensitive member and the developing means as the process means into a unit and which is detachably mountable to the apparatus main assembly. The process cartridge further includes a cartridge which is prepared by integrally assembling the electrophotographic photosensitive member and, as the process cartridge, the charging means, the developing means or the cleaning means into a unit and which is detachably mountable to the apparatus main assembly.

The process cartridge which includes the electrophotographic photosensitive member and the developing means as a unit is referred to as the process cartridge of a so-called integral type. Further, the process cartridge which includes the electrophotographic photosensitive member and the process means other than the developing means as a unit is referred to as the process cartridge of a so-called separation type. That is, the type in which the developing means is provided in a developing unit separately from the process cartridge, and the process cartridge forms the image by being paired with the developing unit is referred to as the so-called separation type. The contact can be mounted to and demounted from the apparatus main assembly by an operator himself (herself). For that reason, maintenance of the apparatus main assembly can be easily carried out.

Further, the developing cartridge includes a developing roller (developer carrying member for supplying the developer to the electrophotographic photosensitive member). Further, the developing cartridge accommodates a powdery developer (toner) used for developing an electrostatic latent image formed on the electrophotographic photosensitive member, and is detachably mountable to the apparatus main assembly.

In the case of the developing cartridge, the electrophotographic photosensitive member is mounted to the apparatus main assembly or a cartridge supporting member. Alternatively, the electrophotographic photosensitive member is provided in the above-described process cartridge of the so-called separation type. In this case, the process cartridge does not include the developing means. Also the developing cartridge can be mounted to and demounted from the apparatus main assembly by the operator himself(herself). For that reason, it is possible to easily carry out the maintenance of the apparatus main assembly.

The toner cartridge is prepared by integrally assembling a device, accommodating the toner, for supplying the accommodated toner to the developing device into a unit, and then is detachably mounted into the apparatus main assembly.

Therefore, the cartridge includes the process cartridge of the so-called integral type or the so-called separation type. The cartridge also includes the case where the process cartridge of the so-called separation type and the developing cartridge are used in a pair. Further, the cartridge includes the case where the electrophotographic photosensitive member is fixedly mounted to the apparatus main assembly or the cartridge supporting member and the developing cartridge is detachably used so as to act on the electrophotographic photosensitive member.

The cartridge includes the toner cartridge. The cartridge further includes an image forming function unit, detachably mountable to the apparatus main assembly, contributing to the image forming process for forming the image on the recording material.

With respect to the cartridge described above, the image forming apparatus main assembly includes a cartridge mounting portion. The cartridge is inserted into the cartridge mounting portion, and then the cartridge mounting portion is closed by an openable member of the apparatus main assembly.

In a conventional process cartridge described in Japanese Laid-Open Patent Application (JP-A) Hei 11-249363, in order to eliminate an incompletely mounted state of the process cartridge into the mounting portion, a constitution in which a projected portion for pushing the process cartridge into a normal position while moving together with the openable member with an opening and closing operation of the openable member has been proposed.

Further, in recent years, a packing type of the cartridge together with the main assembly during shipping such that the process cartridge is packed in the apparatus main assembly during the shipping of the cartridge so that the user can use the cartridge as soon as the user has purchased the image forming apparatus is employed. In this type, in a spacing (gap) between the apparatus main assembly and the process cartridge, a cushioning member such as styrene foam is provided, so that an impact (shock) against the process cartridge during transportation is alleviated.

SUMMARY OF THE INVENTION

According to an aspect of the present invention, there is provided an image forming apparatus for forming an image on a recording material, comprising: a main assembly provided with an opening through which a cartridge is to be mounted into and demounted from the main assembly; an openable member movable between a closed position where the opening is closed and an open position where the opening is open; and the cartridge, including a portion-to-be-urged, detachably mountable to the main assembly in a mounting completion position, wherein the openable member includes a guiding portion including a supporting surface, a recessed portion provided partway of the supporting surface, and an urging portion as a part of the supporting surface, wherein when the openable member is in the open position, the supporting surface is capable of guiding the cartridge to the opening, wherein during a closing operation of the openable member, the urging portion and the portion-to-be-urged contact each other to push the cartridge toward the mounting completion position, and wherein when the openable member is in the closed position, a spacing is provided between the recessed portion and the portion-to-be-urged.

According to another aspect of the present invention, there is provided a main assembly, of an image forming apparatus for forming an image on a recording material, to which a cartridge including a portion-to-be-urged is detachably mountable, the main assembly comprising: an opening through which the cartridge is to be mounted into and demounted from the main assembly; an openable member movable between a closed position where the opening is closed and an open position where the opening is open; and an urging portion provided on the openable member, wherein the openable member includes a guiding portion including a guide, a recessed portion provided partway of the guide, and an urging portion as a part of the guide, wherein when the openable member is in the open position, the guide is capable of guiding the cartridge to the opening, wherein during a closing operation of the openable member, the urging portion and the portion-to-be-urged of the cartridge contact each other to push the cartridge toward the mounting completion position, and wherein when the openable member is in the closed position, a spacing is provided between the recessed portion and the portion-to-be-urged.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described with reference to the drawings.

[Embodiment 1]

Figure 2:
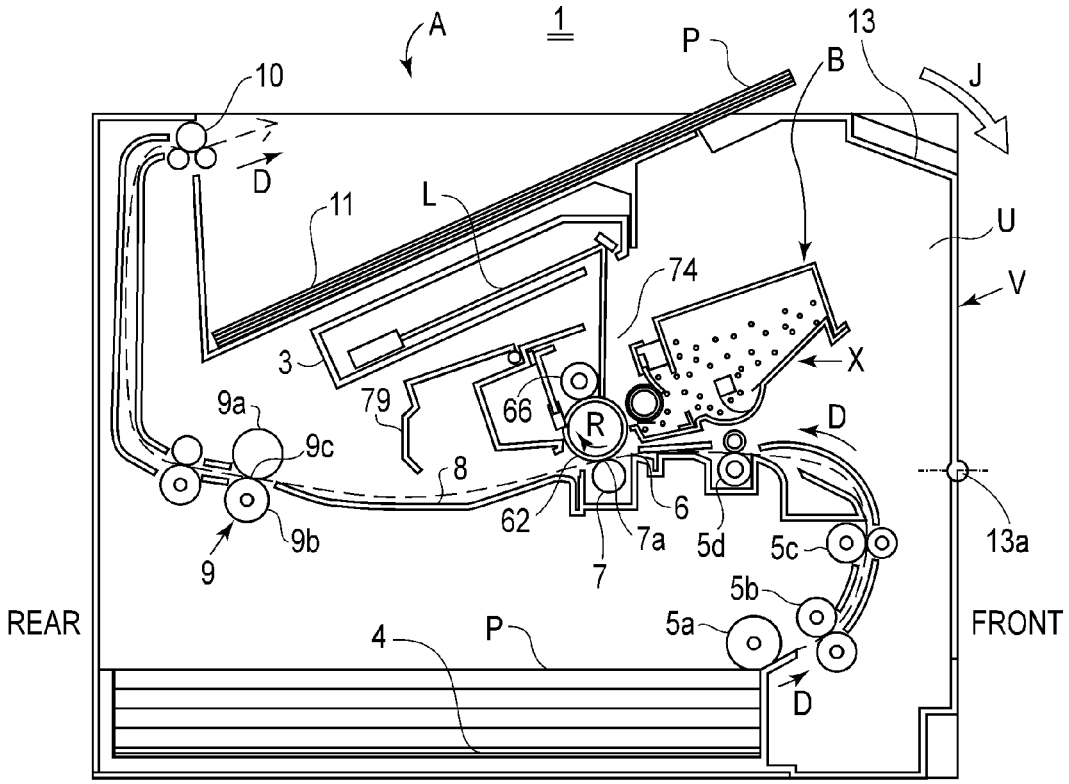
FIG. 2 is a sectional view of the image forming apparatus.
Figure 3:
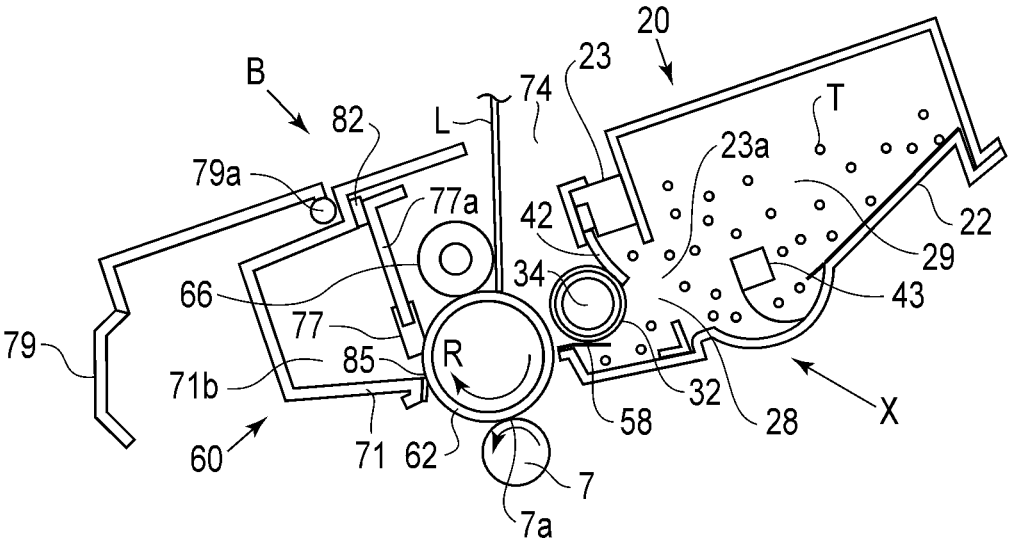
In FIG. 3, (a) and (b) are sectional views of each showing a process cartridge.
Figure 3:
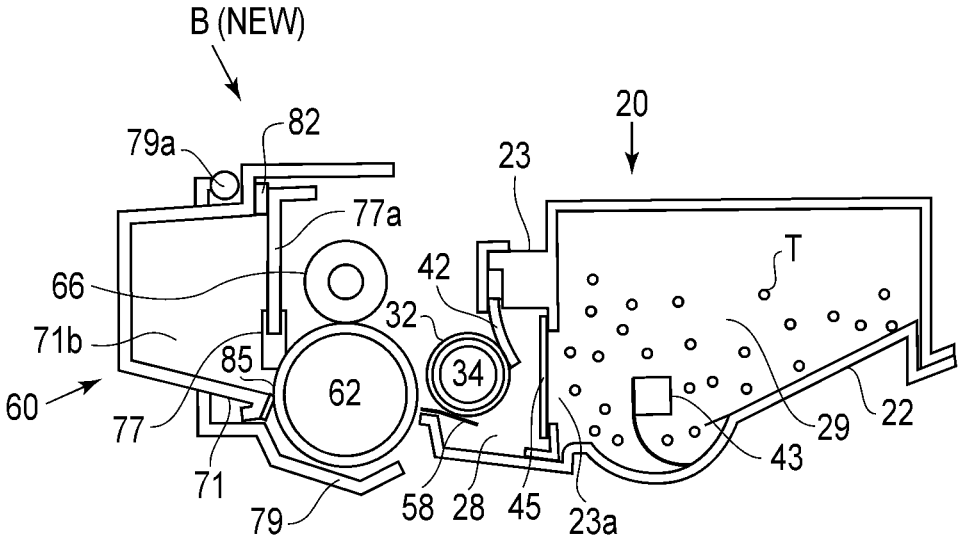

FIG. 2 is a schematic longitudinal left side view of an image forming apparatus 1 in Embodiment 1. In FIG. 3, (a) is an enlarged view of a process cartridge B in the image forming apparatus 1 shown in FIG. 2. This image forming apparatus 1 is a laser printer (electrophotographic image forming apparatus) using an electrophotographic technology. The image forming apparatus 1 is capable of forming and printing out a toner image on a recording material (recording medium) P corresponding to electrical image information inputted from a host device (not shown) such as a personal computer, an image reader or a facsimile machine into a controller (not shown). This image forming apparatus 1 is used after the process cartridge B is detachably mounted into an image forming apparatus main assembly A.

The recording material P is a sheet-shape member on which the toner image is to be formed by the image forming apparatus 1 and includes, e.g., regular or irregular plain paper, thick paper, thin paper, envelope, postcard, seal, resin sheet, OHP sheet, glossy paper and the like.

In the following, a rotational axis direction of an electrophotographic photosensitive drum 62 as an image bearing member is referred to as a longitudinal direction. Further, with respect to the longitudinal direction, a side where the drum 62 receives a driving force from the apparatus main assembly A is referred to as a driving side, and an opposite side thereof is referred to as a non-driving side.

Further, a side where the cartridge B is moved into and out of the apparatus main assembly A is referred to as an apparatus main assembly front side (front surface), and an opposite side thereof is referred to as an apparatus main assembly rear side (rear surface). Further, in a state in which the image forming apparatus 1 is disposed, an upper portion (in a recording material discharge surface 11 side) is referred to as an apparatus main assembly upper portion, and an opposite portion thereof is referred to as an apparatus main assembly lower portion.

[General Structure of Image Forming Apparatus]

Figure 1:
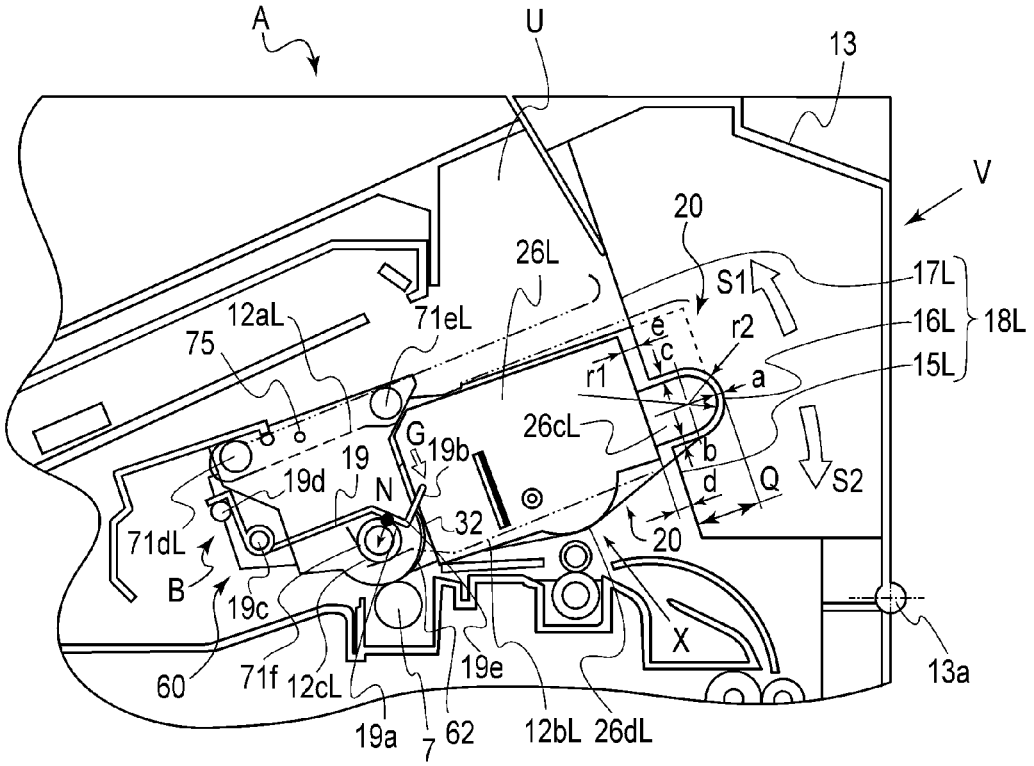
FIG. 1 is a detailed sectional view of a principal part of an image forming apparatus in Embodiment 1.

In the image forming apparatus 1 in FIG. 1, when the cartridge B is mounted in a normal position (mounting position, mounting completion position) inside the apparatus main assembly A, above the cartridge B, an exposure device (laser scanner unit) 3 is provided. Further, below the cartridge B, a sheet tray 4 in which the recording material (sheet material) P as an object on which an image is to be formed is accommodated is provided.

Further, in the apparatus main assembly A, along a conveyance direction D of the sheet material P, a pick-up roller 5*a*, a feeding roller pair 5*b*, a conveying roller pair 5*c*, a registration roller pair 5*d*, a transfer guide 6, a transfer roller 7, a feeding guide 8, a fixing device 9, a discharging roller pair 10, a discharge tray 11 and the like are successively provided. The fixing device 9 is constituted by a heating roller 9*a* and a pressing roller 9*b*.

[Image Forming Process]

Next, an outline of an image forming process will be described. On the basis of a print start signal, the drum 62 is rotationally driven at a predetermined peripheral speed (process speed) in an arrow R direction. Further, a charging roller 66 to which a bias voltage is applied contacts the outer peripheral surface of the rum 62 and electrically charges the outer peripheral surface of the photosensitive drum 62 uniformly.

The exposure device 3 outputs laser light L depending on the image information. The laser light L passes through an exposure window portion 74 provided at an upper surface of the cartridge B, so that the charged outer peripheral surface of the drum 62 is subjected to scanning exposure. As a result, on the outer peripheral surface of the drum 62, an electrostatic latent image depending on the image information is formed.

On the other hand, as shown in (a) of FIG. 3, in a developing device unit 20 as a developing device, a toner T in a toner chamber 29 is stirred and fed by rotation of a feeding member 43, so that the toner T is sent to a toner supplying chamber 28 through a communication opening between the toner chamber 29 and the toner supplying chamber 28. The toner T is carried by a magnetic force of a magnet roller 34 (fixed magnet) on a surface of a developing roller 32. The toner T is regulated in layer thickness by a developing blade (developer regulating member) 42 while being triboelectrically charged. The toner T is transferred onto the drum 62 depending on the electrostatic latent image, so that the electrostatic latent image is visualized as a toner image (developer image).

Further, in synchronism with output timing of the laser light L in the exposure device 3, by the pick-up roller 5*a* and the feeding roller pair 5*b*, the sheet material P accommodated in the sheet tray 4 disposed at a lower portion of the apparatus main assembly A is separated and fed one by one. Then, the sheet material P is fed to a transfer position 7*a* between the drum 62 and the transfer roller 7 via the conveying roller pair 5*c*, the registration roller pair 5*d* and the transfer guide 6. In this transfer position 7*a*, the toner image is successively transferred from the drum 62 onto the sheet material P.

The sheet material P on which the toner image is transferred is separated from the drum 62 and then is fed to the fixing device 9 along the feeding guide 8. Then, the sheet material P passes through a fixing nip 9*c* which is press-contact portion between the heating roller 9*a* and the pressing roller 9*b* which constitute the fixing device 9. At this fixing nip 9*c*, pressure and heat fixing is effected, so that the toner image is fixed on the sheet material P. The sheet material P on which the toner image is fixed is conveyed to the discharging roller pair 10 and then is discharged onto the discharge tray 11 which is a recording material discharge surface (stacking surface) at an upper portion of the apparatus main assembly A.

On the other hand, the drum 62 after the transfer is, after a residual toner on the outer peripheral surface of the drum 62 is removed by a cleaning blade 77, used again in the image forming process. The residual toner removed from the drum 62 is stored in a residual toner chamber 71*b* of a photosensitive member unit (cleaning unit) 60.

The cartridge B in this embodiment is an integral-type process cartridge which includes the drum 62 and, as process means actable on the drum 62, the charging roller 66, the developing roller 32 and the cleaning blade 77 and which is detachably mounted collectively to the apparatus main assembly A.

The cartridge B includes a drum protective member 79 capable of being opened and closed abut a shaft portion 79*a*. When the cartridge B is dismounted from the apparatus main assembly A, as shown in (b) of FIG. 3, the drum protective member 79 is placed in a closed position where the drum protective member 79 covers an externally exposed surface of the drum 62. Further, when the cartridge B is mounted in a normal mounting position X inside the apparatus main assembly A as shown in (a) of FIG. 3, the drum protective member 79 is placed in an open position in a downstream side with respect to a mounting direction of the cartridge B, so that the externally exposed surface of the drum 62 is exposed.

In FIG. 3, (b) is a cross-sectional view of the cartridge B in a brand-new state. In this state, the communication opening 23*a* between the toner chamber 29 and the toner supplying chamber 28 is closed by a toner sealing member 45, so that the toner chamber 29 and the toner supplying chamber 28 are partitioned. As a result, movement of the toner from the toner chamber 29 to the toner supplying chamber 28 is blocked. When the cartridge B is used, the toner sealing member 45 is unsealed and removed.

[General Structure of Cartridge]

Next, with respect to FIGS. 3 and 5, a general structure of the cartridge B will be described.

The cartridge B is constituted by combining the cleaning unit (photosensitive member unit) 60 and the developing device unit 20. FIG. 5 is an exploded perspective view of the cleaning unit 60 and the developing device unit 20 which constitute the cartridge B.

The cleaning unit 60 is constituted by a cleaning frame 71, the drum 62, the charging roller 66, the cleaning blade 77 and the like. On the other hand, the developing device unit 20 is constituted by a bottom member 22, a developing container 23, a developing blade 42, the developing roller 32, a magnet roller 34, the feeding member 43, the toner T, first and second side members 26L and 26R, an urging member 46, and the like.

The cleaning unit 60 and developing device unit 20 are rotationally movably connected with each other by a connecting member 75, so that the cartridge B is constituted.

Specifically, the first and second side members 26L and 26R are provided at end portions of the developing device unit 20 with respect to a longitudinal direction of the developing device unit (a rotational axis direction of the developing roller 32). The first and second side members 26L and 26R are provided with arm portions 26*a*L and 26*a*R, respectively. At free end portions of these arm portions 26*a*L and 26*a*R, rotational movement holes 26*b*L and 26*b*R, respectively, in parallel to the developing roller 32 are provided.

Further, at each of longitudinal end portions of the cleaning frame 71, an engaging hole 71*a* (unshown in the non-driving side) for permitting engagement therein of a connecting member 75 is formed. Then, the arm portions 26*a*L and 26*a*R are aligned with predetermined positions of the cleaning frame 71, and then the connecting members 75 are inserted into the rotational movement holes 26*b*L and 26*b*R and the engaging holes 71*a*. As a result, the cleaning unit 60 and the developing device unit 20 are connected with each other rotatably about the connecting members 75.

At this time, urging members 46 mounted at base portions of the arm portions 26*a*L and 26*a*R abut against the cleaning frame 71, so that the urging members 46 urge the developing device unit 20 toward the cleaning unit 60 with the connecting members 75 as the rotation centers. As a result, the developing roller 32 is pressed toward the drum 62 with reliability. Then, by a gap (spacing) holding member (described later with reference to FIG. 7) mounted at each of the end portions of the developing roller 32, the developing roller 32 is held with a predetermined gap from the drum 62.

[Structure of Cleaning Unit]

Figure 6:
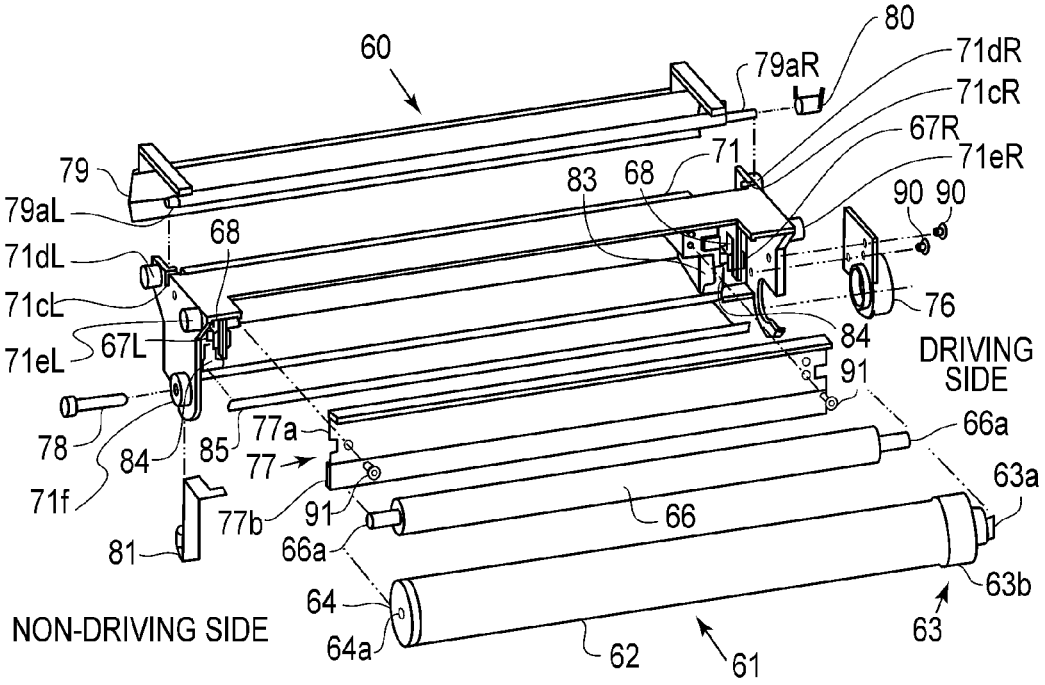
FIG. 6 is an exploded perspective view for illustrating a structure of a cleaning unit (photosensitive member unit) constituting the process cartridge.

A detailed structure of the cleaning unit 60 will be described with reference to FIGS. 3 and 6. FIG. 6 is an exploded perspective view for illustrating the structure of the cleaning unit 60. The cleaning blade 77 is constituted by a supporting member 77*a* formed with a metal plate and an elastic member 77*b* formed of an elastic material such as urethane rubber. The cleaning blade 77 is fixed on the cleaning frame 71 by screws 91 at longitudinal end portions of the supporting member 77*a*, thus being provided in a predetermined position. The elastic member 77*b* contacts the drum 62, so that the residual toner is removed from the outer peripheral surface of the drum 62. The removed toner residual is stored in the residual toner chamber 71*b* (FIG. 3).

A first seal member 82 shown in FIG. 3, a second seal member 83 shown in FIG. 6, a third seal member 84 and a fourth seal member 85 are fixed to the cleaning frame 71 at predetermined positions.

As shown in FIG. 3, the first seal member 82 is provided over the longitudinal direction and prevents the leakage-out of the residual toner from between a supporting member 77*a* of the cleaning blade 77 and the cleaning frame 71. As shown in FIG. 6, the second seal member 83 prevents the leakage-out of the residual toner from longitudinal ends of an elastic member 77*b* of the cleaning blade 77.

The third seal member 84 wipes off a deposited matter such as the toner from the drum 62 while preventing the leakage-out of the residual toner from the longitudinal ends of the elastic member 77*b* of the cleaning blade 77. The fourth seal member 85 is provided in contact with the drum 62 over the longitudinal direction and prevents the leakage-out of the residual toner from an upstream side of the cleaning blade 77 with respect to the rotational direction of the drum 62.

An electrode member 81, an urging member 68 and charging roller bearings 67L and 67R are mounted on the cleaning frame 71. A shaft portion 66*a* of the charging roller 66 is engaged into the charging roller bearings 67L and 67R. The charging roller 66 is urged toward the drum 62 by the urging member 68, and is rotatably supported by the charging roller bearings 67L and 67R. Then, the charging roller 66 is rotated by rotation of the drum 62.

The electrode member 81, the urging member 68, the charging roller bearing 67L and the shaft portion 66*a* have electroconductivity. In a state in which the cartridge B is mounted at the mounting position, the electrode member 81 contacts an electric power supplying portion (not shown) in the apparatus main assembly A. The electric power supplying portion supplies electric power to the charging roller 66 along an electric power supplying path constituted by the above members.

The drum 62 is connected integrally with a non-driving side flange 64 and a driving side flange 63 and thus is constituted as an electrophotographic photosensitive drum unit 61. This connecting method uses caulking, bonding, welding or the like. To the non-driving side flange 64, an unshown grounding contact and the like are connected. Further, the driving side flange 63 includes the driving force receiving portion 63*a* for receiving a driving force from the apparatus main assembly A and includes a flange gear portion 63*b* for transmitting the driving force to the developing roller 32.

The bearing member 76 is integrally fixed to the cleaning frame 71 with screws 90 in the driving side, and the drum shaft 78 is press-fitted and fixed in the cleaning frame 71 in the non-driving side.

Further, the bearing member 76 is engaged with the driving side flange 63, and a drum shaft 78 is engaged with a hole 64*a* of the non-driving side flange 64. As a result, the drum unit 61 is rotatably supported by the cleaning frame 71.

The drum protective member 79 is rotatably supported by the cleaning frame 71 so as to permit protection (light blocking) and exposure of the drum 62. The urging member 80 is mounted on a driving side shaft portion 79*a*R of the drum protective member 79 and urges the drum protective member 79 in a direction of protecting the drum 62. A non-driving side shaft portion 69*a*L and the driving side shaft portion 79*a*R of the drum protective member 79 are engaged with bearing portions 71*c*L and 71*c*R of the cleaning frame 71.

[Developing Device Unit]

A detailed structure of the developing device unit 20 will be described with reference to FIGS. 3 and 7.

Figure 7:
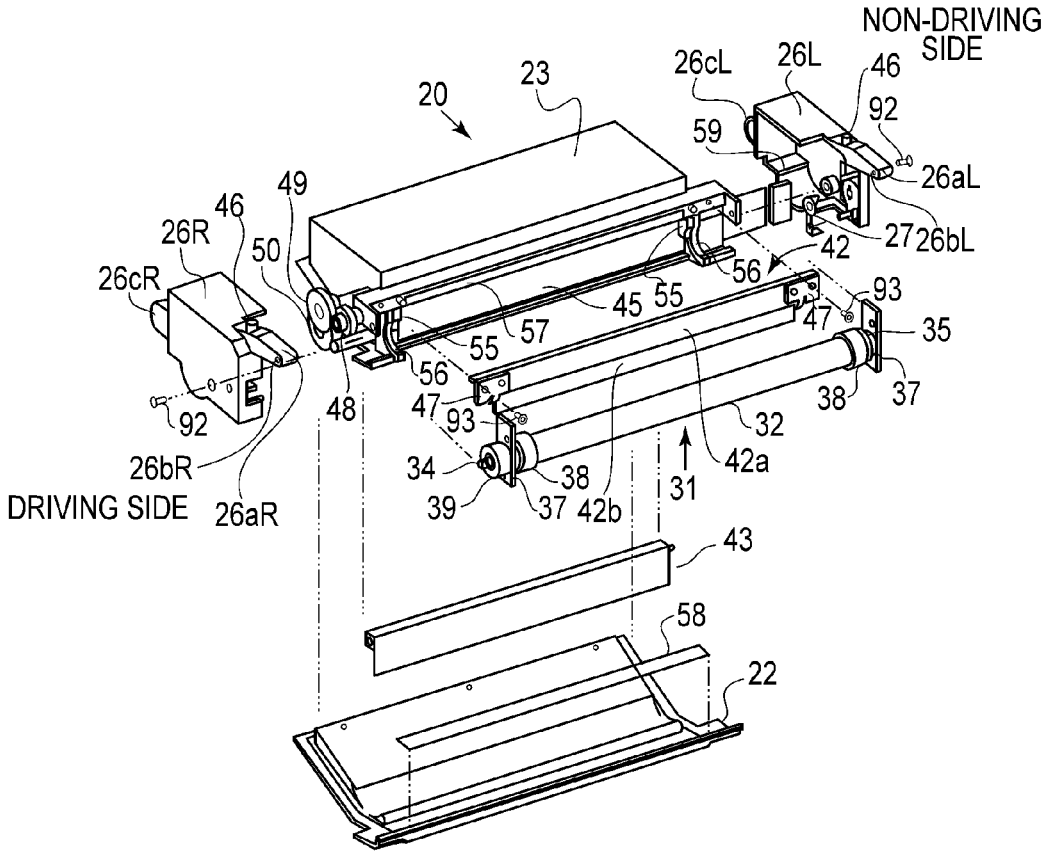
FIG. 7 is an exploded perspective view for illustrating a structure of a developing device unit constituting the process cartridge.

FIG. 7 is an exploded perspective view for illustrating the structure of the developing device unit 20. As shown in FIG. 3, a developing (device) frame consisting of the developing container 23 and the bottom member 22 defines the toner chamber 29 in which the toner T is accommodated, and the toner supplying chamber. The developing container 23 and the bottom member 22 are integrally connected with each other by welding or the like.

The feeding member 43 is supported by the developing container 23 in the non-driving side, and is fixed to a feeding gear 50 mounted in the developing container 23 in the driving side as shown in FIG. 7. As a result, as shown in FIG. 3, the feeding member 43 is rotated in the toner chamber 29 by the rotation of the feeding gear 50.

The toner sealing member 45 is (thermally) welded with the developing container 23 and partitions the toner chamber 29 and the toner supplying chamber 28, between which the communication opening 23*a* is sealed by the toner sealing member 45 as shown in (b) of FIG. 3 in the cartridge B in an unused and brand-new state. As a result, the toner sealing member 45 prevents the leakage-out of the toner T from the toner chamber 28 during transportation of the cartridge B. When the brand-new cartridge B is used, a user pulls out the toner sealing member 45 to the outside of the cartridge B, whereby the toner T in the toner chamber 29 is fed into the toner supplying chamber 28.

As shown in FIG. 7, a first seal member 55, a second seal member 56 and a third seal member 57 are provided at predetermined positions of the developing container 23. A fourth seal member 58 is provided at a predetermined position of the bottom member 22 after the developing container 23 and the bottom member 22 are connected with each other. Further, a fifth seal member 59 is provided on the developing container 23.

The first seal member 55 prevents the leakage-out of the toner T from longitudinal ends of an elastic member 42*b* of the developing blade 42. The second seal member 56 prevents the leakage-out of the toner T from longitudinal ends of the developing roller 32. The third seal member 57 is provided over the longitudinal direction and prevents the leakage-out of the toner T from between a supporting member 42*a* of the developing blade 42 and the developing container 23. The fourth seal member 58 is provided in contact with the developing roller 32 over the longitudinal direction and prevents the leakage-out of the toner T from the lower side of the developing roller 32.

The fifth seal member 59 prevents, when the toner seal member 45 is removed and taken out from a removal opening (not shown) to an outside of the developing device unit 20, the leakage-out of the toner T in intimate contact with the removal opening simultaneously with wiping of the toner T deposited on the surface of the toner seal member 45.

The developing blade 42 is constituted by a supporting member 42*a* formed with a metal plate and an elastic member 42*b* formed of an elastic material such as a urethane rubber, and is fixed together with a cleaning member 47 in a predetermined position relative to the developing container 23 by screws 93 at end portions of the supporting member 42*a*. The elastic member 42*b* contacts the developing roller 32, thus defining a toner amount at the peripheral surface of the developing roller 32 and at the same time, imparting triboelectric charges to the toner T. The cleaning member 47 removes the deposited matter such as the toner T by contact with an end portion surface of the developing roller 32. A developing roller unit 31 is constituted by the developing roller 32, the magnet roller 34, a flange 35, the gap holding member 38, a bearing member 37, a developing roller gear 39 and the like. From an end portion of the developing roller 32 in the non-driving side, the magnet roller 34 is inserted, and at the end portion, the flange 35 is press-fitted and fixed. With the flange 35, an electroconductive electrode member (not shown) is assembled, and contacts the developing roller 32 and the electrode member 27. The electroconductive electrode member 27 is fixed to the first side member 26L.

In the state in which the cartridge B is mounted in the apparatus main assembly A, the electrode member 27 contacts the electric power supplying portion (not shown) provided in the apparatus main assembly A. As a result, the electric power is supplied to the developing roller 32 through the electrode member 27 and the electroconductive electrode member (not shown) as an electric power supplying path. The gap holding member 38 is mounted at each of the end portions of the developing roller 32. Further, outside the gap holding member 38, the bearing member 37 is disposed, and in the driving side, the developing roller gear 39 is assembled outside the bearing member 37. By the bearing member 37 disposed at each of the end portions of the developing roller 32, the developing roller 32 is rotatably supported. First and second gears 48 and 49 as a drive transmission member are rotatably engaged with the developing frame 1.

As a result, the driving force from the apparatus main assembly A is transmitted to the developing roller 32 and the feeding member 43 by successive engagement and rotation of a developing roller gear 39, a first gear 48, a second gear 49 and a feeding gear 50.

The first and second side members 26L and 26R are fixed with screws 92 at end portions, respectively, of the developing frame with respect to the longitudinal direction of the developing frame. At that time, the bearing members 37 of the developing roller unit 31 are held by the first and second side members 26L and 26R.

[Mounting and Demounting of Cartridge and Positioning of Cartridge]

Figure 10:
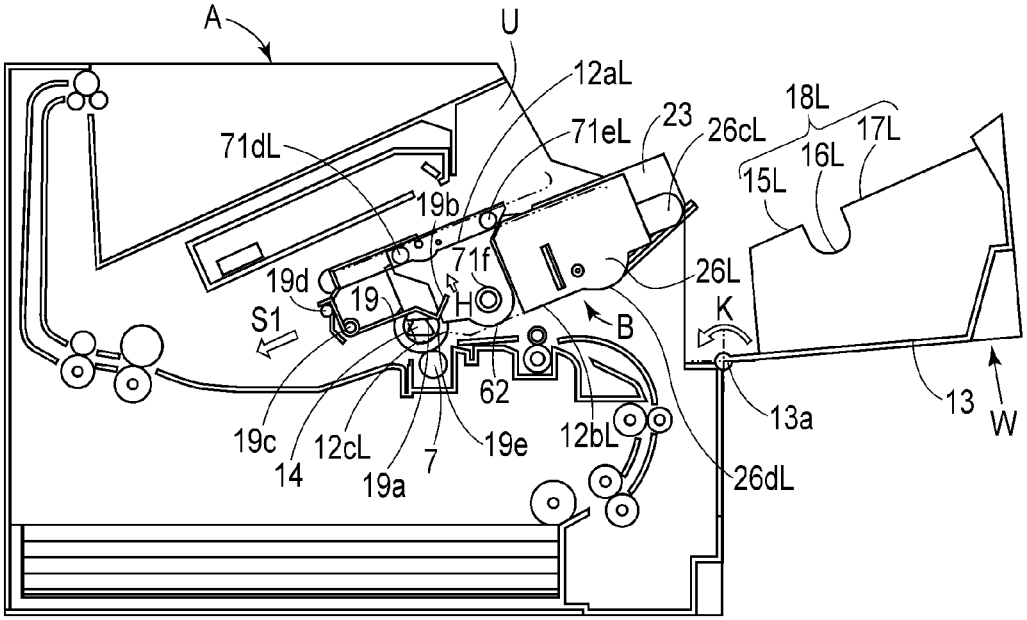
FIGS. 10 and 11 are sectional views each showing the image forming apparatus for illustrating the mounting process of the process cartridge.

Mounting and demounting of the cartridge B relative to the apparatus main assembly A and positioning of the cartridge B relative to the apparatus main assembly A will be described with reference to FIGS. 1, 4 and 10. FIG. 1 is a detailed sectional view of the apparatus main assembly A in a state in which an openable member 13 is closed. FIG. 10 is a sectional view of the apparatus main assembly A in a state in which the openable member 13 is open, and shows a state in which the cartridge B is mounted partway into the apparatus main assembly A.

FIGS. 1 and 10 are the sectional views of the apparatus main assembly A, and are side views of the cartridge B as seen from the non-driving side. In these figures, a non-driving side guiding rail l2*a*L, a positioning portion l2*c*L and a lower guide l2*b*L are indicated by a chain double-dashed line, and a lead-in spring 19 is indicated by a solid line. For the openable member 13, a non-driving side structure is shown. This is true for sectional views (FIGS. 11, 13 and 14) of the apparatus main assembly A described later. The structures described later are those in the non-driving side, and the same structures are employed also in the driving side. Therefore, the structure will be omitted from detailed description.

Figure 4:
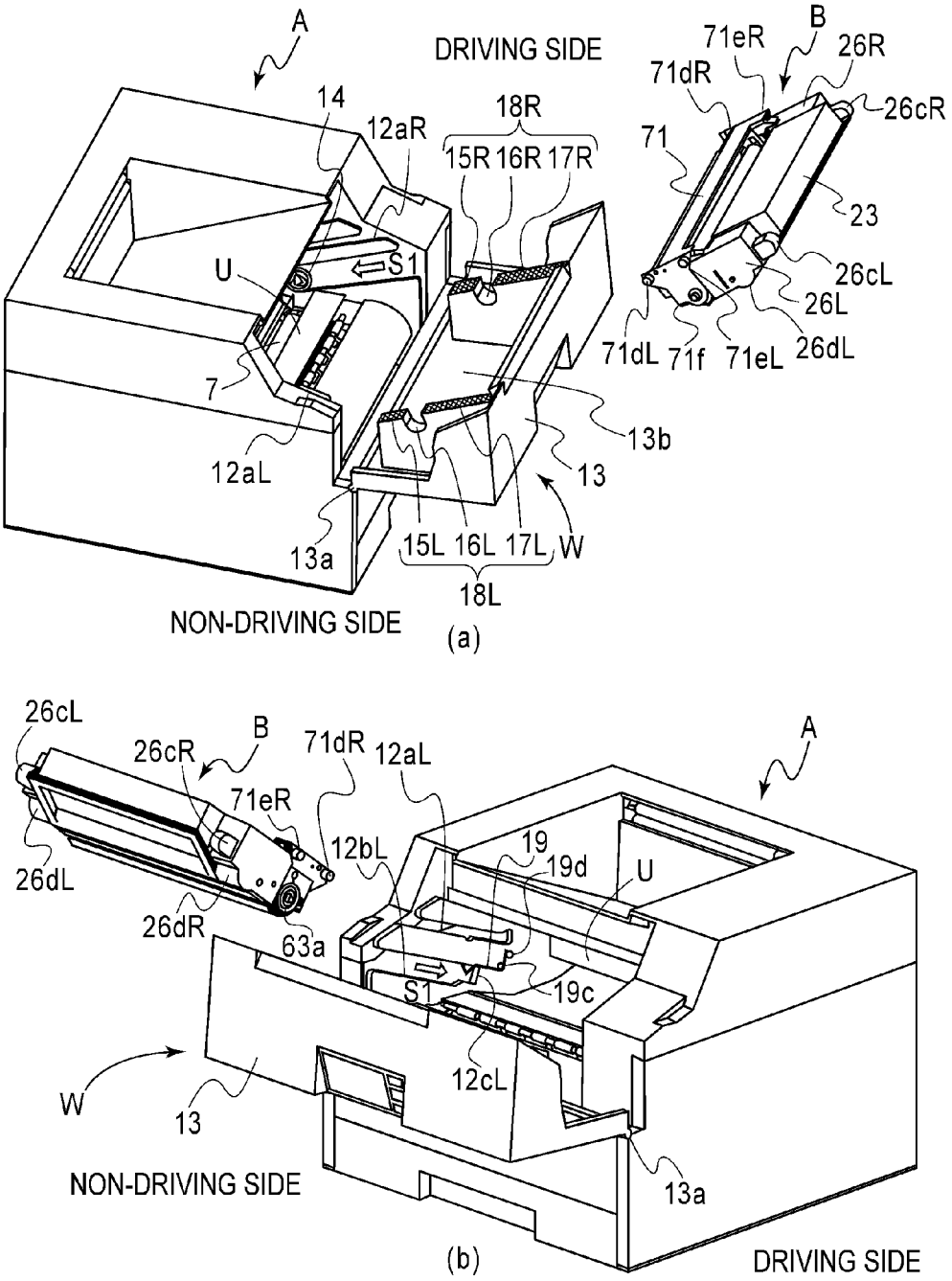
In FIG. 4, (a) and (b) are perspective views each for showing a main assembly of the image forming apparatus and the process cartridge.

In FIG. 4, (a) and (b) are perspective views each showing the apparatus main assembly A in which the openable member 13 is opened for mounting and demounting the cartridge B and showing the cartridge B, wherein (a) is the perspective view as seen from above the apparatus main assembly A in the non-driving side, and (b) is the perspective view as seen from above the apparatus main assembly A in the driving side.

The apparatus main assembly A includes an opening U through which the cartridge B is mounted into and demounted from the apparatus main assembly A. Further, the apparatus main assembly A includes the openable member 13 movable between a closed position V where the opening U is closed and a position W where the opening U is open. Specifically, as shown in FIG. 4, the openable member 13 is mounted on the apparatus main assembly A so as to be openable and rotatable about a rotation (movement) shaft 13*a* as a rotation (movement) center.

FIGS. 1 and 2 shows a state in which the openable member 13 is rotated to the closed position V relative to the apparatus main assembly A and in which the opening U of the apparatus main assembly A is closed. The openable member 13 placed in the closed position V can be moved to the open position W by being rotated about the rotation shaft 13*a* in an arrow J direction in FIG. 2, i.e., by being rotated toward the front side of the apparatus main assembly A as shown in FIGS. 4 and 10. By this opening operation of the openable member 13, the opening U of the apparatus main assembly A is largely opened, so that the user has access to the inside of the apparatus main assembly A.

At inner side surfaces of the apparatus main assembly A in the driving side and the non-driving side, the driving side guiding rail 12*a*R and the non-driving side guiding rail 12*a*L which are used as a guide for guiding the cartridge B to the inside and the outside of the apparatus main assembly A are provided, respectively (FIG. 4).

These guiding rails 12*a*L and 12*a*R regulate the mounting direction of the cartridge B relative to the apparatus main assembly A. That is, the guiding rails 12$a$L and 12$a$R guide the cartridge B, inserted in the apparatus main assembly A through the opening U, to a state of a normal position X (mounting position, mounting completion position) of FIGS. 1 and 2 inside the apparatus main assembly A where the image is to be formed. On the other hand, the guiding rails 12$a$L and 12$a$R guide the cartridge B in a demounting direction from the normal position X to the outside of the apparatus main assembly A. The mounting and demounting of the cartridge B relative to the apparatus main assembly A are made after the member 13 is opened.

Figure 5:
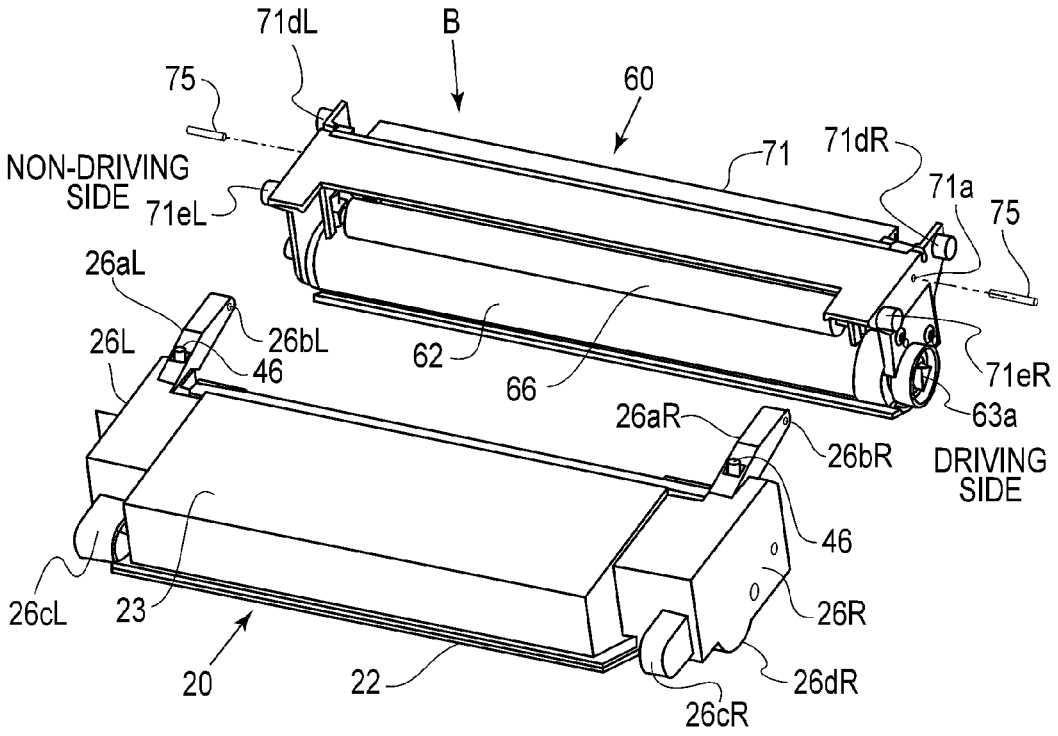
FIG. 5 is an exploded perspective view for illustrating a structure of the process cartridge.

As shown in FIGS. 4 and 5, on longitudinal side surfaces of the cleaning frame 71 of the cartridge B, driving side bosses 71$d$R and 71$e$R and non-driving side bosses 71$d$L and 71$e$L are provided. The cartridge B is gradually inserted into the apparatus main assembly A in an arrow S1 direction (FIG. 4) while moving the driving side bosses 71$d$R and 71$e$R along the driving side guiding rail 12$a$R and moving the non-driving side bosses 71$d$L and 71$e$L along the non-driving side guiding rail 12$a$L.

As a result, a non-driving side cylindrical portion 71$f$((a) of FIG. 4) of the cartridge B gradually enters the apparatus main assembly A along the lower guide 12$b$L. When the cylindrical portion 71$f$ abuts against the positioning portion 12$c$L, the mounting of the cartridge B into the apparatus main assembly A is completed, so that the cartridge B can be mounted in the normal position X (FIGS. 1 and 2) where the image is formable.

As shown in FIG. 1, (b) of FIG. 4 and FIG. 10, in the apparatus main assembly A, the lead-in spring 19 for leading-in the cartridge B in order to cause the drum 62 to oppose and contact the transfer roller 7 is provided. The lead-in spring 19 is rotatably supported by a rotation shaft 19$c$ and is positionally fixed at a locking portion. As shown in FIG. 10, when the user inserts the cartridge B in the arrow S1 direction, the lead-in spring 19 moves in an arrow H direction by contact between the cylindrical portion 71$f$ of the cartridge B and an acting portion 19$b$ thereof.

Then, the cylindrical portion 71$f$ of the cartridge B rides over a corner 19$e$ of the lead-in spring 19 and contacts an urging portion 19$a$ as shown in FIG. 1. As a result, the cylindrical portion 71$f$ of the cartridge B receives an urging force N, and then abuts against the apparatus main assembly positioning portion 12$c$L, thus being placed in the normal position X. Herein, the normal position X of the cartridge where the image is formable in the apparatus main assembly A is a position where the drum 62 opposes the transfer roller 7.

A drive inputting shaft 14 ((a) of FIG. 4 and FIG. 10) driven by a motor (not shown) of the apparatus main assembly A engages with the driving force receiving portion 63$a$ ((b) of FIG. 4 and FIGS. 5 and 6) provided on the cartridge B. As a result, the drum 62 connected with the driving portion receiving portion 63$a$ is rotated by receiving the driving force from the apparatus main assembly A.

Further, the electrode member 81 shown in FIG. 6 contacts an electric power supplying portion (not shown) of the apparatus main assembly A and supplies electric power to the developing roller 32 via the electric power supplying path described above in the structure of the developing device unit 20.

[Structure of Openable Member]

Figure 8:
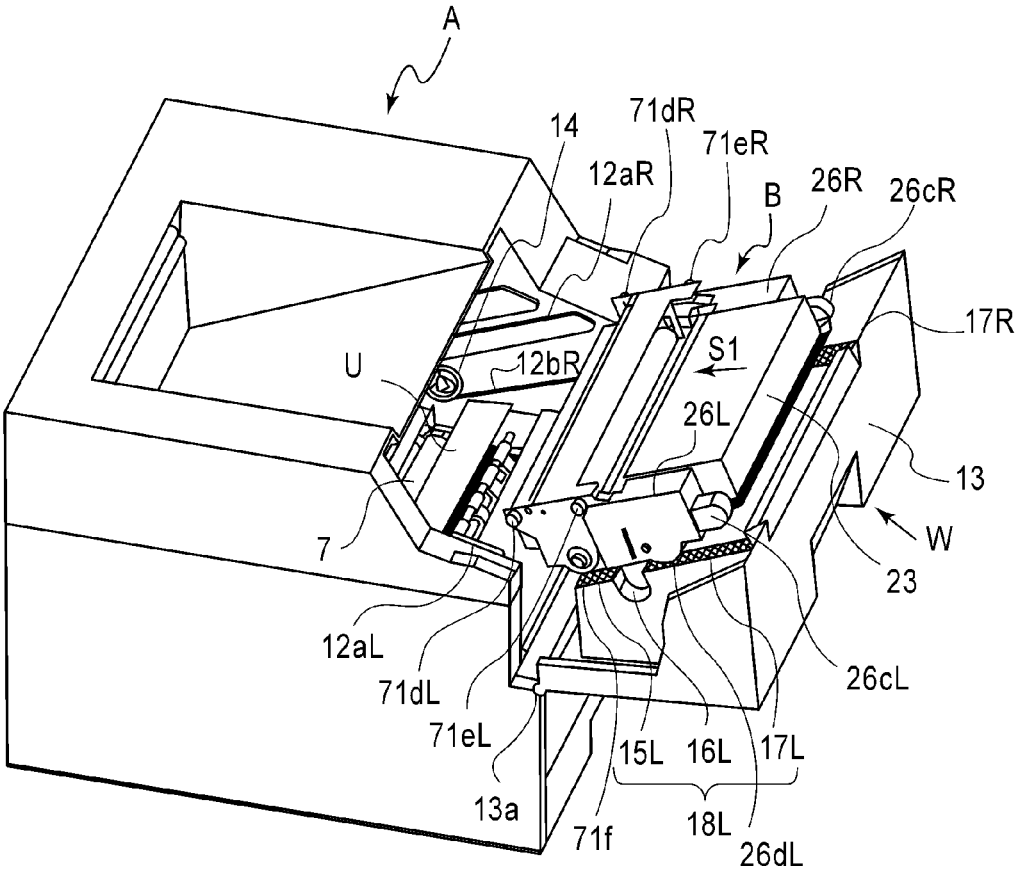
FIGS. 8 and 9 are each showing the image forming apparatus main assembly and the process cartridge for illustrating a mounting process of the process cartridge.
Figure 9:
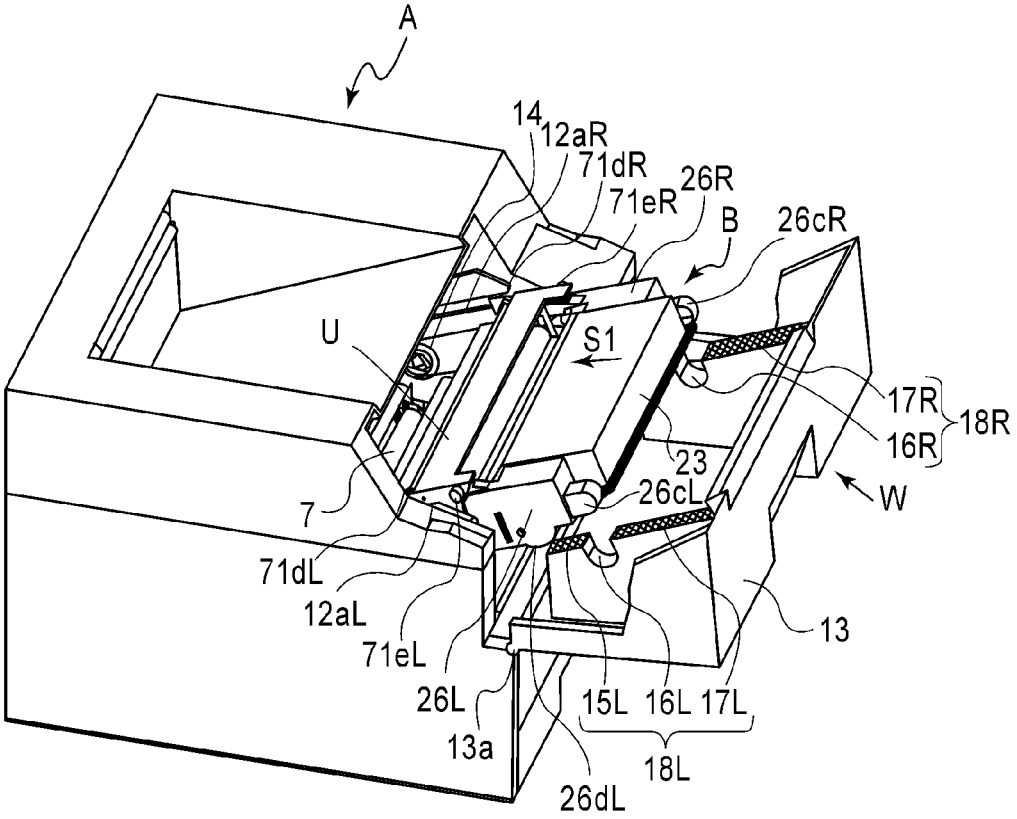

Next, a structure of the openable member 13 will be described with reference to FIGS. 1, 4, 8 and 9. FIGS. 8 and 9 are perspective views of the apparatus main assembly A and the cartridge B. The member 13 can be moved from the closed position V where the opening U is closed as shown in FIGS. 1 and 2 to the open position W where the opening U is open by rotating about the rotation shaft 13$a$ as a rotation flucrum by about 90 degrees as shown in FIGS. 4, 8 and 9. At the open position W, further opening of the openable member 13 is limited.

As shown (a) of FIG. 4, inside the openable member 13 are supporting portions 18L and 18R on which the cartridge B is to be placed and mounted when the user mounts the cartridge B into the apparatus main assembly A. These supporting portions 18L and 18R assist engagement of the bosses 71$d$R and 71$e$R of the cartridge B with the driving side guiding rail l2$a$R and engagement of the bosses 71$d$L and 71$e$L with the non-driving side guiding rail 12$a$L. An operation for assisting the engagement is such that the state of the cartridge B is changed from the state of FIG. 8 to the state of FIG. 9.

Each groove width of the driving side guiding rail l2$a$R and the non-driving side guiding rail 12$a$L is set at a value larger than a diameter of each of the bosses 71 $d$L, 71$e$L, 71$d$R and 71$e$R of the cartridge B, so that the cartridge B can be smoothly inserted into and pulled out from the apparatus main assembly A.

The supporting portions 18L and 18R are disposed as a non-driving side guide and a driving side guide, respectively, at longitudinal inside end portions of the openable member 13, and supporting surfaces 15L, 15R, 17L and 17R thereof are formed in the substantially same height (crosshatched portions in (a) of FIG. 4).

The cartridge B is placed on the supporting portions 18L and 18R so that longitudinal positions thereof are aligned with the driving side guiding rail 12$a$R and the non-driving side guiding rail l2$a$L (FIG. 8). At this time, the supporting portions support surfaces-to-be-supported 26$d$L and 26$d$R ((b) of FIG. 4) formed at lower surfaces of the first side member 26L and the second side member 26R of the cartridge B. Then, as shown in FIG. 9, the bosses 71$d$R and 71eR are engaged with the driving side guiding rail l2$a$R, and the bosses 71$d$L and 71$e$L are engaged with the non-driving side guiding rail l2$a$L.

The above-mentioned structure is summarized as follows. The apparatus main assembly A includes the guides 12$a$L and 12$a$R for regulating the mounting direction of the cartridge B. The openable member 13 includes the supporting surfaces 15L, 15R, 17L and 17R for assisting the regulation of the cartridge B by the guides 12$a$L and 12$a$R immediately before the regulation of the cartridge B by the guides 12$a$L and 12$a$R. The cartridge B includes the surfaces-to-be-supported 26$d$L and 26$d$R capable with the supporting surfaces 15L, 15R, 17L and 17R.

[Mounting of Cartridge from Incompletely Mounted State]

Figure 11:
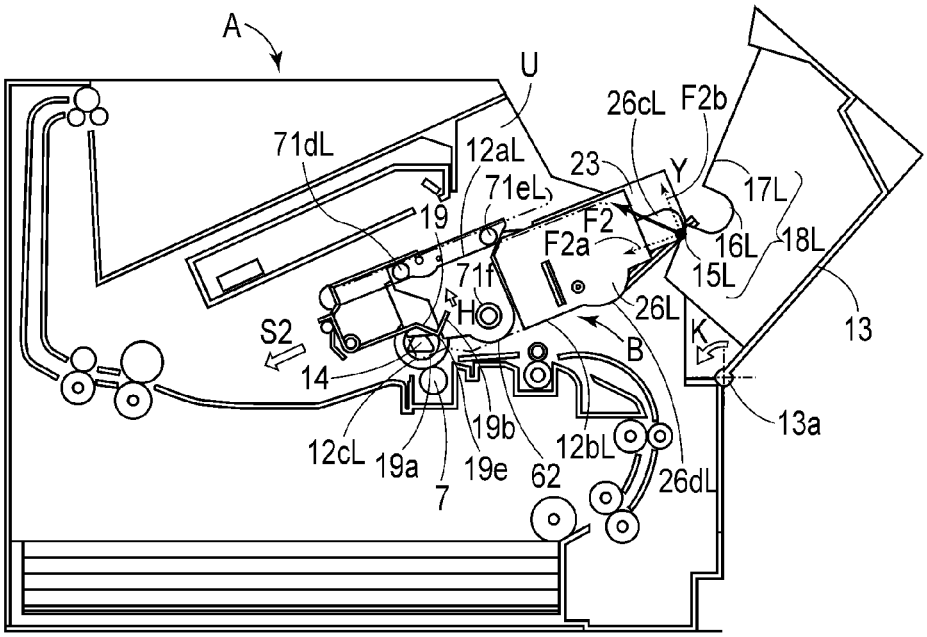
Figure 14:
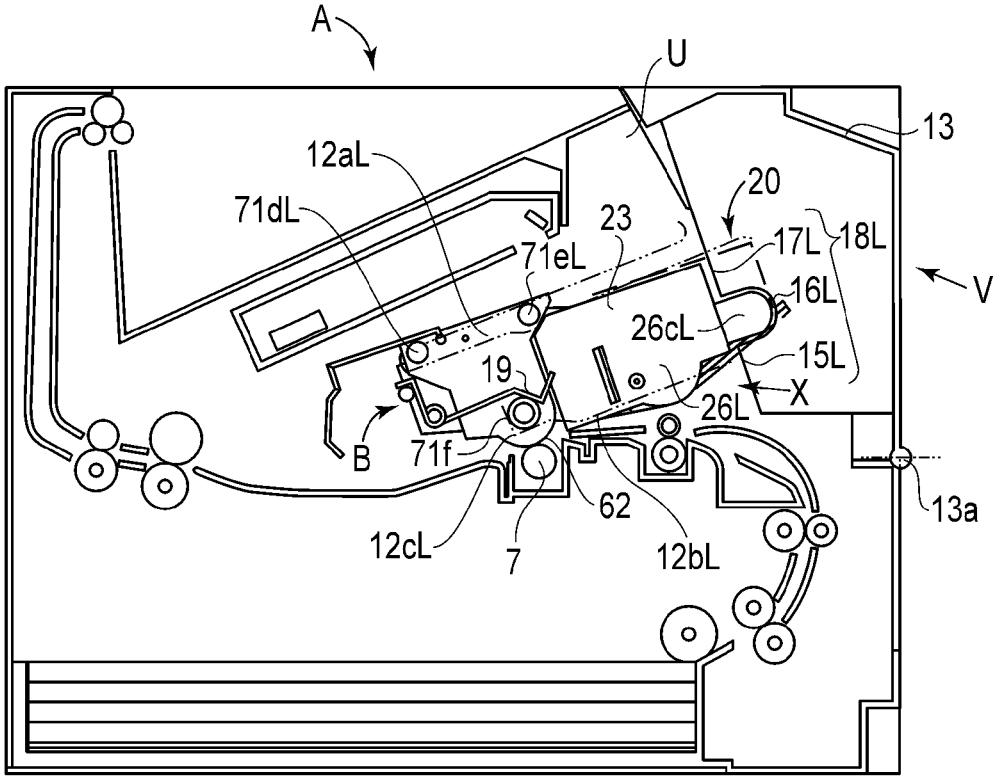

Next, the mounting of the cartridge B from an incompletely mounted state will be described with reference to FIGS. 1, 11 and 14. FIGS. 11 and 14 are sectional views of the apparatus main assembly A. FIG. 14 shows the normal position X (mounted state) of the cartridge B where the image is formable inside the apparatus main assembly A and where the drum 62 opposes the transfer roller 7. On the other hand, FIG. 11 shows an incompletely mounted state of the cartridge B in the apparatus main assembly A in which the drum 62 is spaced from the transfer roller 7. That is, the cylindrical portion 71$f$ is spaced from the positioning portion 12$c$L.

As shown in FIG. 11, of the supporting surfaces 15L (15R) and 17L (17R), the supporting surface 15L (15R) also functions as an urging portion. This urging portion 15L (15R) generates, when the cartridge B is in the incompletely mounted state, an urging force F2 for mounting the cartridge B in the normal position X, where the image is formable, with an operation for closing the openable member 13 in an arrow K direction. Details of the operation will be described later.

Further, the side member 26L (26R) of the cartridge B includes a portion-to-be-urged 26*c*L (26*c*R) for receiving the urging force from the urging portion 15L (15R). The portion-to-be-urged 26*c*L (26*c*R) is constituted by a projected-shape portion extending in the direction of the openable member 13, and an outer shape thereof in cross-section is an arcuate shape.

FIG. 1 is a detailed enlarged view showing the mounted state (FIG. 14) of the cartridge B. As shown in FIG. 1, the supporting portion 18L (18R) of the openable member 13 includes an accommodating portion 16L (16R) having a recessed shape of Q in depth corresponding to the portion-to-be-urged 26*c*L (26*c*R). The outer shape of the accommodating portion 16L (16R) in cross-section is formed so as to be somewhat larger than the outer shape of the portion-to-be-urged 26*c*L (26*c*R) in cross-section. Therefore, during completion of the mounting of the cartridge B into the apparatus main assembly A, the portion-to-be-urged 26*c*L (26*c*R) is accommodated in the accommodating portion 16L (16R) while leaving spacings a, b, c, d and e. Details of these spacings will be described later.

Figure 12:
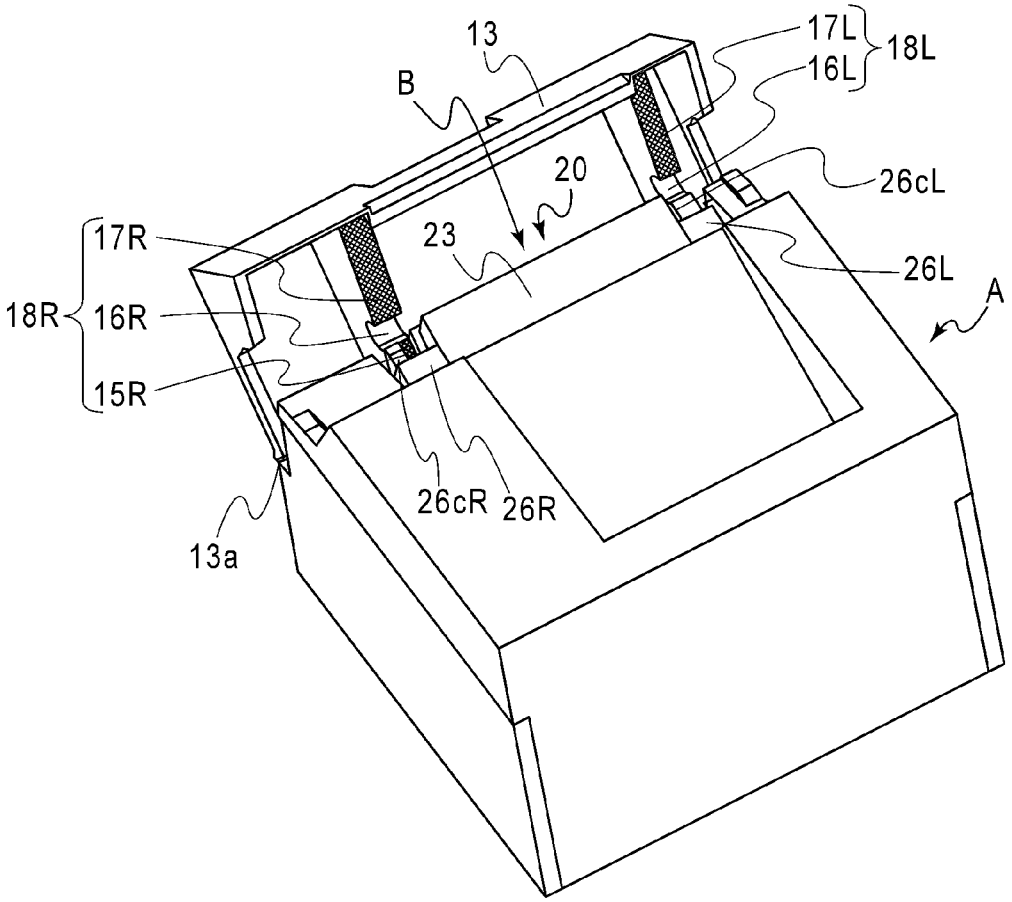
FIG. 12 is a perspective view of the image forming apparatus for illustrating the mounting process of the process cartridge.
Figure 13:
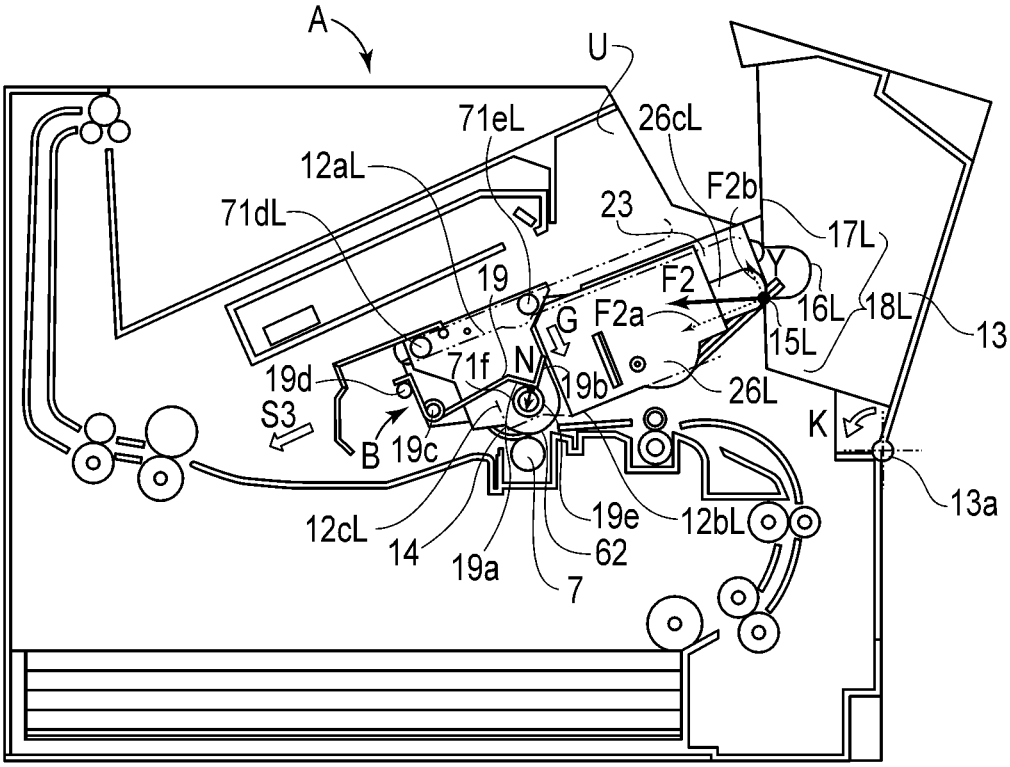
FIGS. 13 and 14 are sectional views each showing the image forming apparatus for illustrating the mounting process of the process cartridge.

Here, the mounting method of the cartridge B into the apparatus main assembly A will be described further specifically with reference to FIG. 4, FIGS. 8-14 and FIG. 1. FIG. 12 is a perspective view of the apparatus main assembly A and the cartridge B. FIG. 13 is a sectional view of the apparatus main assembly 13.

First, as shown in FIG. 4, the openable member 13 of the apparatus main assembly A is placed in the open position W where the openable member 13 is in an open state. Next, as shown in FIG. 8, the cartridge B is positionally aligned with the openable member 13 placed in the open state as shown in FIG. 8. At that time, the portions-to-be-supported 26*d*L and 26*d*R (FIG. 4) formed at the lower surfaces of the first and second side members 26L and 26R of the cartridge B are moved along the supporting surfaces 15L, 15R, 17L and 17R (cross hatched portions) of the supporting portions 18L and 18R provided on the openable member 13, thus being mounted on the supporting surfaces 15L, 15R, 17L and 17R. As a result, the cartridge B is placed in the state of the FIG. 8.

In that state, when the cartridge B is gradually inserted into the apparatus main assembly A, as shown in FIG. 9, the bosses 71*d*L and 71*d*R provided on the cartridge B in the downstream side with respect to the cartridge mounting direction are engaged with the driving side guiding rail 12*a*R and the non-driving side guiding rail 12*a*L. When the cartridge B is further inserted into the apparatus main assembly A, as shown in FIG. 10, the boss 71*e*L (71*e*R) of the cartridge B in the developing device unit 20 side is engaged with the groove of the guiding rail 12*a*L (12*a*R).

As a result, the bosses 71*d*L (71*d*R) and 71*e*L (71*e*R) of the cartridge B are placed in the supported state by the guiding rail 12*a*L (12*a*R). In this state, the drum 62 does not reach the position opposing the transfer roller 7, so that the cartridge B is not mounted in the normal position X where the image is formable. Further, centers of the drum 62 and the drive inputting shaft 14 are deviated from each other, so that the cartridge B is also in the state in which the driving force cannot be transmitted to the cartridge B. Therefore, in general, as shown in FIG. 14, the user pushes the cartridge B into the apparatus main assembly A to place the cartridge B in the normal position X where the image is formable, thus completing the mounting of the cartridge B.

However, in some cases, the user would consider that the state in which the bosses 71*d*L (71*d*R) and 71*e*L (71*e*R) of the cartridge B are supported by the guiding rail 12*a*L (12*a*R) as shown in FIG. 10 is the mounting completion state. Thus, in some cases, the user stops the cartridge mounting operation inside the apparatus main assembly A. This state is referred to as the incompletely mounted state.

Further, the cartridge B can be guided to the normal position X, where the image is formable, by gravitation, but friction generates at a sliding portion or the like between the guiding rail 12*a*L (12*a*R) and each of the bosses 71*d*L (71*d*R) and 71*e*L (71*e*R). For that reason, in some cases, only by the gravitation, the cartridge B does not reach the normal position X.

In the following, even when the cartridge B is in the incompletely mounted state, a process for completely mounting the cartridge B in the normal position X, where the image is formable, by the closing operation of the openable member 13 will be described. From the state of FIG. 10, when the openable door (openable member) 13 is gradually closed about the rotation shaft 13*a* as the rotation center in the arrow K direction (counterclockwise direction in FIG. 10), the cartridge B reaches the state of FIG. 11. Thus, as shown in FIG. 11, the supporting surface 15L (15R) as the opening portion provided on the openable member 13 contacts the portion-to-be-urged 26*c*L (26*c*R) provided on the first side member 26L (26R).

When the openable door 13 is further closed about the rotation shaft 13*a* as the rotation center in the arrow K direction (counterclockwise direction in FIG. 11), the urging force F2 is exerted on the portion-to-be-urged 26*c*L (26*c*R). By a component force F2*a* of the urging force F2, a force for pushing the cartridge B in an arrow S2 direction is generated. The arrow S2 direction which is the mounting direction and the guiding rail 12*a*L (12*a*R) are parallel to each other. When a direction perpendicular to the arrow S2 direction is an arrow Y direction, a component force F2*b* directed in the arrow Y direction is generated by the urging force F2, and therefore the cartridge B can be floated from the guiding rail l2*a*L (l2*a*R) in the arrow Y direction.

That is, when the urging portions 15L and 15R urge the portions-to-be-urged 26*c*L and 26*c*R, a contact pressure between the cartridge B and each of the guiding rails 12*a*L and 12*a*R is decreased. As a result, a degree of the friction generated during the mounting of the cartridge B at the sliding portion between the guiding rail 12*a*L (12*a*R) and each of the bosses 71*d*L (71*d*R) and 71*e*L (71*e*R) can be reduced. As a result, the cartridge B can be more easily pushed into the apparatus main assembly A.

FIG. 12 is a perspective view of the apparatus main assembly A, in the same state as the incompletely mounted state of FIG. 11, as seen from obliquely above the apparatus main assembly A. As shown in FIG. 12, the supporting surfaces 15R and 15L as the urging portions are provided at longitudinal end portions of the openable member 13. As a result, it is possible to substantially simultaneously urge the portion-to-be-urged 26*c*R, provided on the first side member 26R, by the supporting surface 15R and urge the portion-to-be-urged 26*c*L, provided on the second side member 26L, by the supporting surface 15L (not shown). Therefore, the cartridge B can be stably pushed into the apparatus main assembly A without being twisted, so that the cartridge B can be mounted in the image formable position with reliability.

From the state of FIG. 11 (FIG. 12), when the openable door 13 is further closed about the rotation shaft 13*a* as the rotation center in the arrow K direction (counterclockwise direction in FIG. 11), the cylindrical portion 71*f* of the cartridge B abuts against the acting portion 19*b* of the lead-in spring 19, so that the cartridge B moves in the arrow H direction. Then, the cylindrical portion 71*f* contacts the spring 19, so that the cartridge B reaches the state of FIG. 13.

As shown in FIG. 13, the cylindrical portion 71*f* of the cartridge B contacts the urging portion 19*a* to receive the urging force N, so that the cylindrical portion 71*f* is to be positioned by the apparatus main assembly positioning portion 12*c*L. As a result, the pulling-in of the cartridge B in an arrow S3 direction starts. Further, from the state of FIG. 13, when the openable door 13 is further closed about the rotation shaft 13*a* as the rotation center in the arrow K direction (counterclockwise direction in FIG. 13), the cartridge B reaches the state of FIG. 14.

By the above-described series of operations, during the change in state from FIG. 13 to FIG. 14, the mounting force exerted on the cartridge B is changed from the pushing-in force of the cartridge B by the urging force F2 to the pulling-in force of the cartridge B by the lead-in spring 19. As a result, the cartridge B can be placed in the normal position X, where the image is formable, with reliability. In the mounted state as shown in FIG. 14, the portion-to-be-urged 26*c*L (26*c*R) provided on the first side member 26L (26R) is accommodated in the recess-shaped accommodating portion 16L (16R) provided in the supporting portion 18L (18R).

Further, the cross-sectional outer shape of the accommodating portion 16L (16R) is somewhat larger than the cross-sectional outer shape of the portion-to-be-urged 26*c*L (26*c*R), and therefore the accommodating portion 16L (16R) does not contact the portion-to-be-urged 26*c*L (26*c*R) in the mounted state of the cartridge B.

This will be specifically described with reference to FIG. 1. FIG. 1 is the detailed enlarged view of the apparatus main assembly 1 and the cartridge B in the mounted state (FIG. 14). The outer shapes of the portion-to-be-urged 26*c*L (26*c*R) and the accommodating portion 16L (16R) are formed so that when a radius of the arcuate portion of the portion-to-be-urged 26*c*L (26*c*R) is r1, the arcuate portion of the accommodating portion 16L (16R) has a radius r2 (>r1). For that reason, in the cartridge mounted state, the spacing a is provided between the arcuate portions of these portions.

Further, between the portion-to-be-urged 26*c*L (26*c*R) and the accommodating portions 16L (16R), the lower spacing b and the upper spacing c are provided. Further, between surfaces of the first side member 26L (26R) and the urging portion 15L (15R) at their opposing portion, the spacing d is provided. Further, between surfaces of the first side member 26L (26R) and the supporting surface 17L (17R) at their opposing portion, the spacing e is provided. These spacings a, b, c, d and e are determined in view of variations or the like in part dimensions, and are set so as to be always provided in the cartridge mounted state.

The above-described constitutions are summarized as follows. In a mounting process of the cartridge B into the apparatus main assembly A at a position other than the normal position X where the image is formable, during the closing operation of the openable member 13, the urging portions 15L and 15R contact the portions-to-be-urged 26*c*L and 26*c*R, respectively. Further, at the time of completion of the mounting of the cartridge B, the urging portions 15L and 15R and the portions-to-be-urged 26*c*L and 26*c*R engage with each other while leaving the spacings a to e with respect to the direction crossing the cartridge mounting direction.

Therefore, in the cartridge mounted state, the openable member 13 does not contact a constitution part (element) such as the side member 26L (26R) constituting the cartridge B.

As described above in the general structure of the cartridge B, the developing device unit 20 is connected rotatably with the cleaning unit 60 about the connecting member 75. About the connecting member 75 as the rotation center, the developing device unit 20 is urged against the cleaning unit 60, so that the developing roller 32 is pressed against the drum 62 with reliability. Then, the developing roller 32 is held with a predetermined gap from the drum 62 by the gap holding member 38 (FIG. 7) provided at longitudinal end portions of the developing roller 32.

Therefore, the developing device unit 20 is positioned relative to only the cleaning unit 60, so that by the constitution of the present invention, a good image can be obtained during image formation without hindering setting of the developing device unit 20.

Further, in recent years, in order that the user can use the image forming apparatus as soon as the user has purchased the image forming apparatus, the cartridge packing method with the main assembly during the cartridge shipping, in which the cartridge B is packed in the apparatus main assembly A during the shipping of the image forming apparatus is employed. In this packing method, after factory shipping, there is a possibility that vibration and impact (shock) by transportation are exerted on the cartridge B packed in the apparatus main assembly A.

As described above, the developing device unit 20 is connected, with the cleaning unit 60, rotatably about the connecting member 75. Further, the urging member 46 rotates and urges the developing device unit 20 toward the cleaning unit 60 about the connecting member 75 as the rotation center. As a result, the developing roller 32 is pressed against the cleaning unit 60.

Therefore, there is a possibility that the transportation vibration and impact are applied to the cartridge B packed in the apparatus main assembly A, and thus the developing device unit 20 is rotated about the connecting member 75 in the arrow Si and S2 directions against the urging force toward the cleaning unit 60. There is a liability that excessive rotation and the impact generated simultaneously by the excessive rotation causes frictional damage of the drum 62 by the developing roller 32 to result in image defect. Further, there is also a liability that parts constituting the cartridge B are broken.

The image defect and breakage of the parts can be prevented by employing the above-described constitution of this embodiment, i.e., by engaging the urging portion 26*c*L (26*c*R) with the accommodating portion 16L (16R) as shown in FIG. 1. That is, in the case where the developing device unit 20 is rotated in a distance which is not less than each of the spacings a, b, c, d and e, the rotation of the developing device unit 20 is limited, so that the frictional damage of the drum 62 by the developing roller 32 can be prevented. Further, it is also possible to prevent the breakage of the parts. As a result, it is possible to obtain a good image.

In this embodiment, description was made based on the constitution in which the portion-to-be-urged 26*c*R has the projected shape and the accommodating portion 16R has the recessed shape, but even when a reverse constitution is employed, an effect similar to that of this embodiment can be obtained. However, as shown in FIG. 8, the constitution in which the portion-to-be-urged 26*c*L (26*c*R) has the projected shape and the accommodating portion 16L (16R) has the recessed shape may preferably be employed. That is, the projected shape is not formed on the supporting surfaces 15L, 17L, (15R), (17R) (crosshatched portions in FIG. 8) of the supporting portion 18L (18R) of the openable member 13 placed in the open state. As a result, when the cartridge B is inserted into the apparatus main assembly A along the supporting portion 18L (18R), the cartridge B can be smoothly guided without being caught by the projected portion.

In FIG. 1, dimensions of Q, r1, r2, a, b, c, d and e described in this embodiment are Q=9 mm, r1=7 mm, r2=9 mm, a, b, c=2 mm and d, e=3 mm, respectively. However, these dimensions are not limited thereto, but an effect similar to that in this embodiment can be obtained when the above-described relation among these spacings can be satisfied. Further, the spacing e may also be set at a large value within a range of not affecting ease of mounting of the member 13 for the cartridge B.

Further, the cross-sectional outer shapes of the portions-to-be-urged 26*c*L and 26*c*R and the corresponding accommodating portions 16L and 16R are not limited to the arcuate shape, but may also be other shapes so long as projected and recessed shapes by which the effect of the present invention can be obtained are formed. For example, the cross-sectional outer shape may also be a triangular shape or a rectangular shape, so that the similar effect can be obtained.

The cartridge (process cartridge) B may also have a constitution in which the developing device unit 20 includes the side member at one end portion thereof with respect to the axial direction of the developing roller 32 and in which the side member includes the portion-to-be-urged. Further, as in this embodiment, the cartridge B may also have the constitution in which the side members 26L and 26R are provided at longitudinal end portions of the developing device unit 20 with respect to the axial direction of the developing roller 32 and in which the side members 26L and 26R include the portions-to-be-urged 26*c*L and 26*c*R.

Further, this embodiment is also applicable to the developing cartridge including the developing roller and the apparatus main assembly to which the developing cartridge is detachably mountable, so that the similar effect can be obtained. Further, this embodiment is also applicable to the toner cartridge accommodating the toner and the apparatus main assembly to which the toner cartridge is detachably mountable, so that the similar effect can be obtained.

[Embodiment 2]

Embodiment 2 of the present invention will be described with reference to the drawings. In this embodiment, portions different from those in Embodiment 1 will be described specifically. Constitutions and the like in this embodiment are the same as those in Embodiment 1 unless otherwise specified. Such constitutions or portions are represented by the same reference numerals or symbols and will be omitted from detailed description.

Figure 15:
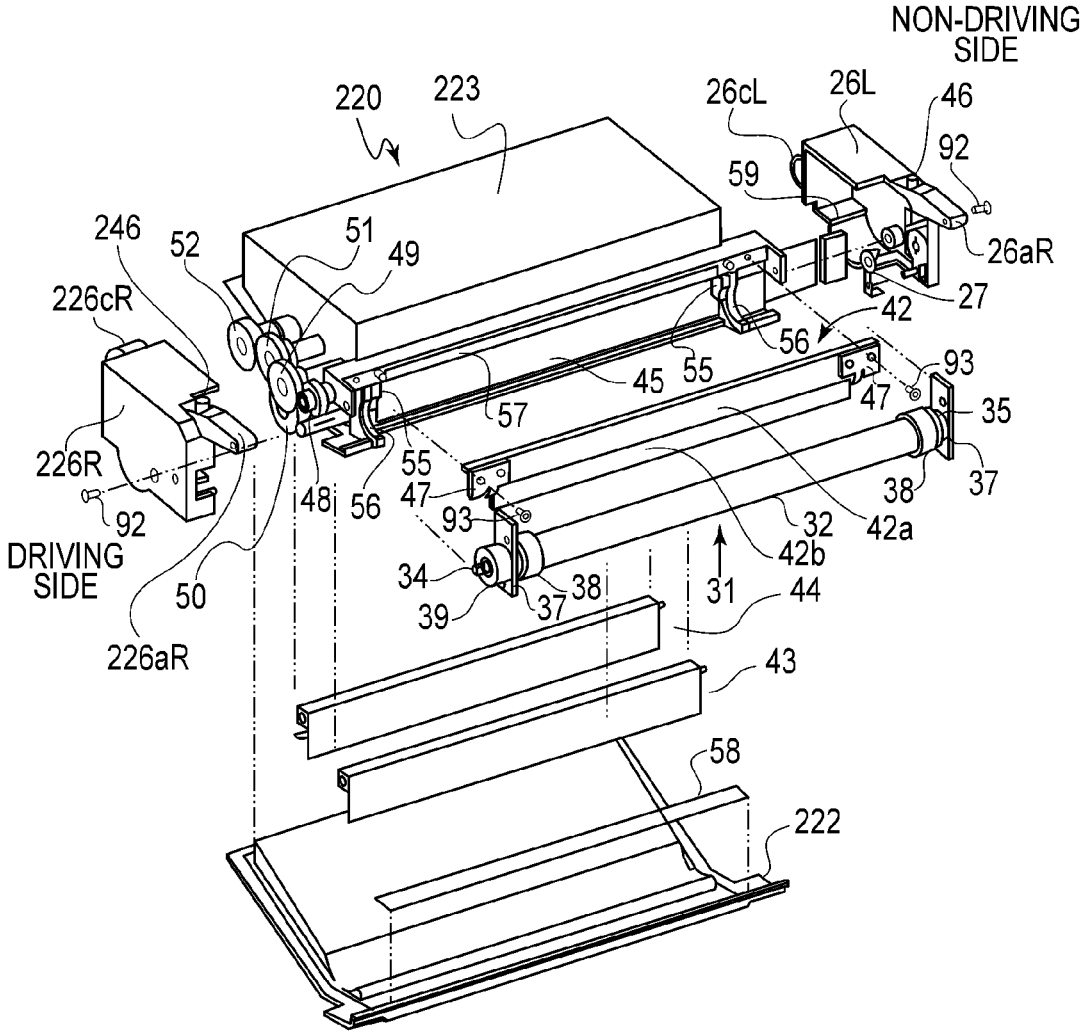
FIG. 15 is an exploded perspective view for illustrating a structure of a developing device unit in Embodiment 2.
Figure 16:
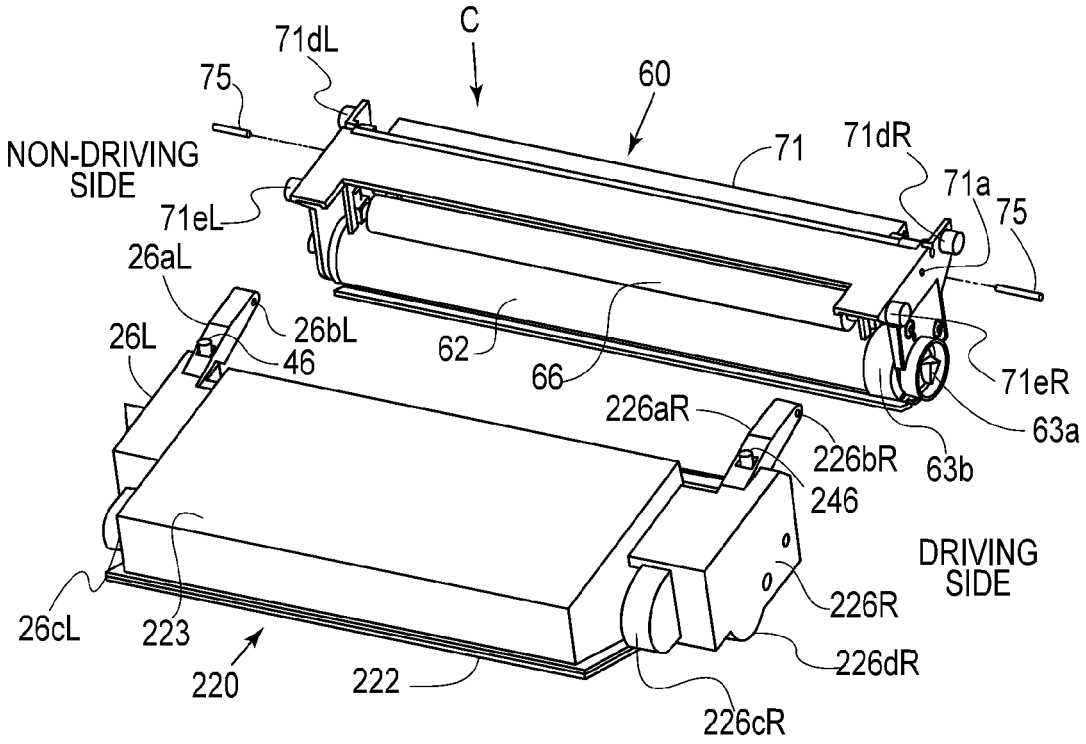
FIG. 16 is an exploded perspective view for illustrating a structure of a process cartridge in Embodiment 2.
Figure 17:
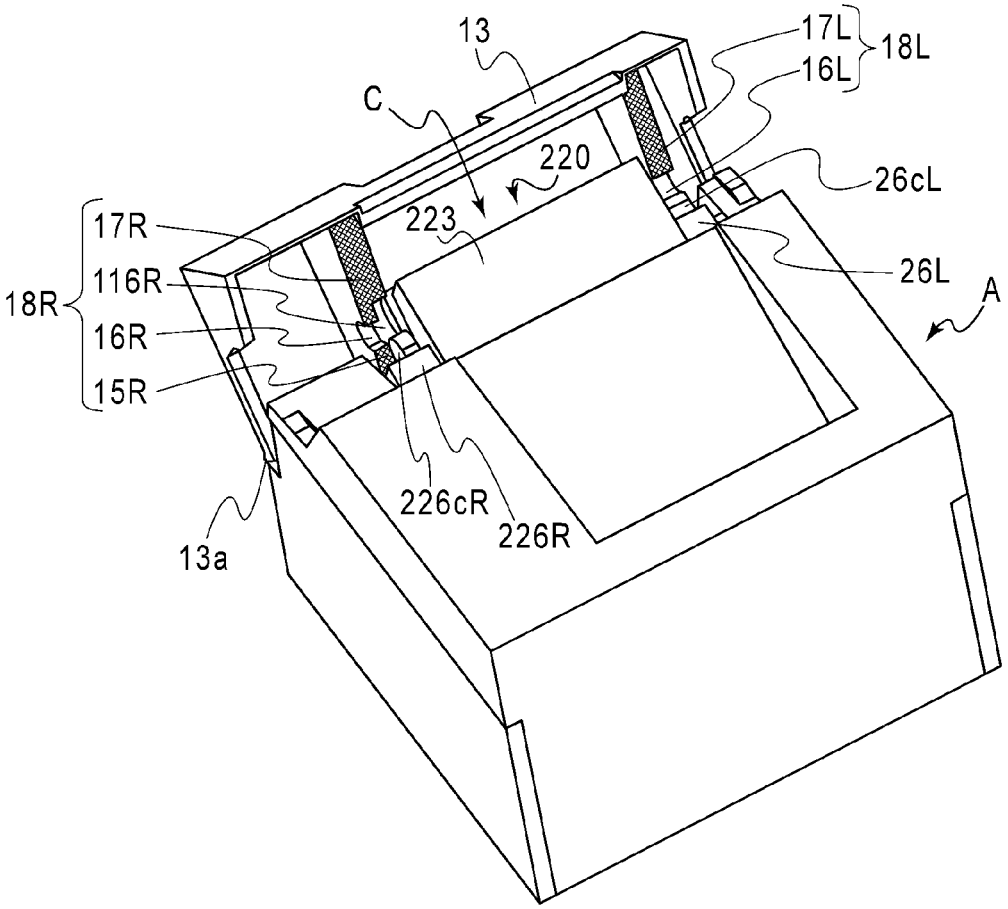
FIG. 17 is a perspective view of an image forming apparatus for illustrating the mounting process of the process cartridge.
Figure 18:
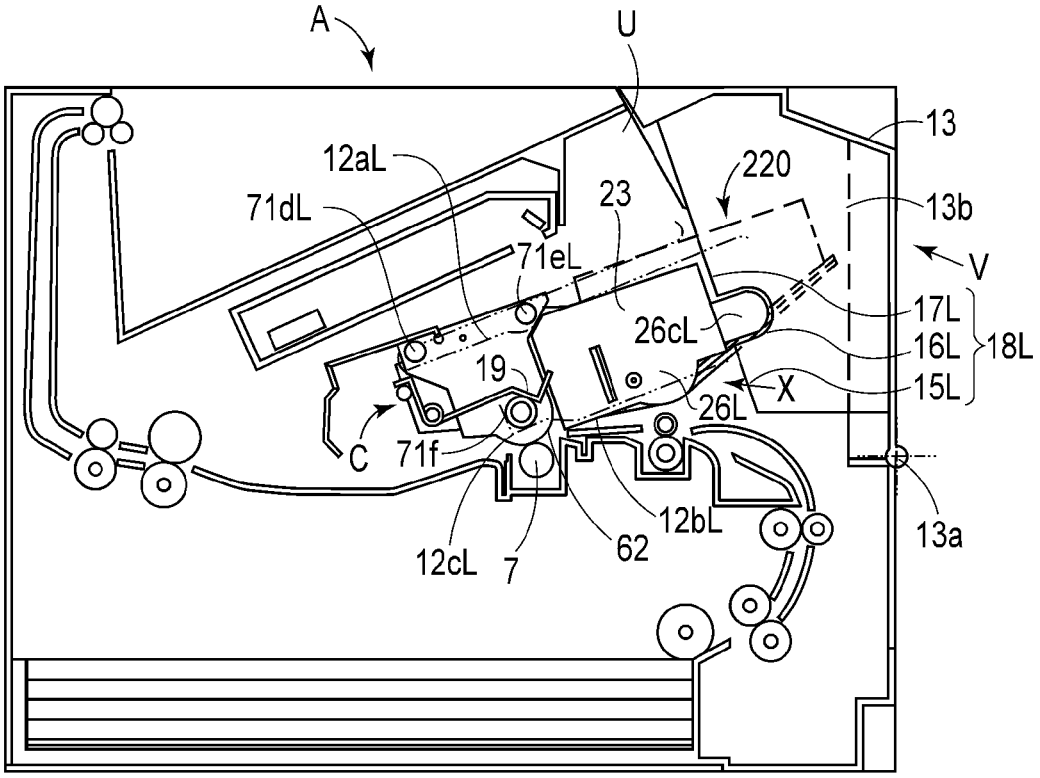
FIG. 18 is a sectional view of the image forming apparatus for illustrating the mounting process of the process cartridge.

FIG. 15 is a perspective view for illustrating a structure of a developing device unit in this embodiment. FIG. 16 is a perspective view for illustrating a structure of a process cartridge in this embodiment. FIG. 17 is a perspective view of an image forming apparatus main assembly in this embodiment. FIG. 18 is a sectional view of the image forming apparatus main assembly.

In recent years, a type in which a cartridge including two or more developing device units different in toner volume relative to a single apparatus main assembly is usable and in which the cartridge including toners different in lifetime of the toner is provided so as to meet a need of use of the use has been employed.

FIG. 16 shows a large-volume cartridge C increased in toner volume compared with the cartridge B (FIG. 5) in Embodiment 1. FIG. 15 shows a large-volume developing device unit 220 used in the large-volume cartridge C.

A difference of the developing device unit 220 from the developing device unit 20 in Embodiment 1 is as follows. As shown in FIG. 15, in order to increase the toner volume, a developing (device) frame is constituted by a developing container 223 and a bottom member 222 which are larger than the developing container 23 and the bottom member 22 used in Embodiment 1. The bottom member 222 and the developing container 223 are connected integrally with each other by a such as welding. The first side member 26L for making connection with the cleaning unit 60 can be made common to Embodiments 1 and 2.

With the increase in toner volume, in order to improve a toner circulating property, a second feeding 44 is needed in some cases. In such a case, the second side member 26R as a gear box is replaced with a large-sized third side member 226R. As a result, a second stirring gear 52 for transmitting the driving force of the second feeding member 44 can be additionally provided in a space created by upsizing the gear box.

Specifically, as shown in FIG. 16, the large-sized third side member 226R includes a portion-to-be-urged 226*c*R which is larger than the portion-to-be-urged 26*c*R used in FIG. 1 and shown in FIG. 5. As a result, as shown in FIG. 15, the second stirring gear 52 can be disposed inside the large-sized portion-to-be-urged 226*c*R. Further, between a first stirring gear 50 and the second stirring gear 52, a third gear as a driving force transmitting member is rotatably mounted on the developing container 223.

As a result, the driving force received from the apparatus main assembly A is transmitted toward the developing roller 32, the first feeding member 43 and the second feeding member 44. That is, the driving force is transmitted to the developing roller 32, the first feeding member 43 and the second feeding member 44 by successive engagement rotation of a flange gear portion 63*b* (FIG. 16) and gears shown in FIG. 15 including the developing roller gear 39, the first gear 48, the second gear 49, the first feeding (stirring) gear 50, the third gear 51 and the second feeding (stirring) gear 52. Further, the third side member 226R is fixed on the developing frame using a screw 92 from a longitudinal side surface.

Although described in Embodiment 1, as shown in (a) of FIG. 4, the supporting portion 18R is provided inside the openable member 13 in the driving side of the apparatus main assembly A. The supporting portion 18R is constituted by the supporting surfaces 15R and 17R and the accommodating portion 16R, formed between the supporting surfaces 15R and 17R, for accommodating the portion-to-be-urged 26*c*R of the cartridge B.

On the other hand, in this embodiment (Embodiment 2), the following portion is added in the apparatus main assembly side compared with Embodiment 1. That is, as shown in FIG. 17, the supporting portion 18R includes an accommodating portion 116R for accommodating the portion-to-be-urged 226*c*R of the cartridge C in Embodiment 2 so as to be parallel to the accommodating portion 16R with respect to the longitudinal direction.

A relation between the cross-sectional outer shapes of the portion-to-be-urged 226*c*R and the accommodating portion 116R is the same as that between the cross-sectional outer shapes of the portion-to-be-urged 26*c*R and the accommodating portion 16R shown in Embodiment 1 except that sizes thereof are different from each other. The portion-to-be-urged 26*c*R of the cartridge B in Embodiment 1 and the portion-to-be-urged 226*c*R of the cartridge C in Embodiment 2 are disposed and shifted from each other in the longitudinal direction. Further, the portions-to-be-urged 26*c*R and 226*c*R are formed on the second side member 26R and the third side member 226R so as to be accommodated in the accommodating portion 16R and the accommodating portion 116R, respectively.

By employing the above constitution, as shown in FIG. 18, the non-driving side first side member 26L used in the cartridge B having a normal toner volume can be used similarly as in this embodiment for the developing device unit 220 which is increased in toner volume and which is to be connected with the cartridge C in this embodiment. For that reason, an effect similar to that in Embodiment 1 can be obtained. Further, a space inside an inner wall 13*b* of the openable member 13 can be used as an accommodating space for the developing device unit 220, so that the toner volume of the developing device unit 220 can be increased.

Further, as shown in FIG. 17, also with respect to the driving side third side member 226R, the portion-to-be-urged 226*c*R different in outer shape from the portion-to-be-urged 26*c*R described in Embodiment 1 is disposed and shifted in the longitudinal direction. Further, the accommodating portion 16R and the accommodating portion 116R provided correspondingly to the portions-to-be-urged 26*c*R and 226*c*R are formed and shifted in the longitudinal direction on the supporting portion 18R of the openable member 13. For that reason, by the replacement of the side member, it is possible to obtain the similar effect to the effect of Embodiment 1.

Further, in this embodiment, as an example in which the two or more portions have different side members, due to the increase in toner volume, the second feeding member 44 (FIG. 15) for improving stirring power is required. In addition, the side member is required to have the gear space for transmitting the driving force. For that reason, a commonality of the side member cannot be achieved between the two or more process cartridges in the example. However, for not only the above reason but also another reason, addition of side members different in shape is needed in some cases.

Therefore, with respect to the two or more cartridges B and C, a method in which the commonality of the first side member 26L is achieved in the non-driving side and in which the second side member 26R and the third side member 226R are selectively used in the driving side was described above. However, even when the two species of the side members are selectively used in the non-driving side, it is possible to obtain the similar effect to that in Embodiment 1.

Further, it is also possible to use a combination of three or more urging portions with three or more portions-to-be-urged, and these portions can be disposed in a width of the supporting portion 18R of the openable member 13 to the possible extent. Also in such a case, the effect similar to that in Embodiment 1 can be achieved.

In this embodiment, description was made based on the constitution in which each of portion-to-be-urged 26*c*R and the portion-to-be-urged 226*c*R has the projected shape and each of the accommodating portions 16R and 116R has the recessed shape, but even when a reverse constitution is employed, an effect similar to that of this embodiment can be obtained.

However, as shown in FIG. 17, the constitution in which the portion-to-be-urged 26*c*L (26*c*R) has the projected shape and the accommodating portion 16L (116R) has the recessed shape may preferably be employed. That is, the projected shape is not formed on the supporting surfaces 15L, 17L, (15R), (17R) (crosshatched portions in FIG. 17) of the supporting portion 18L (18R) of the openable member 13 placed in the open state. As a result, when the cartridge C is inserted into the apparatus main assembly A along the supporting portion 18L (18R), the cartridge C can be smoothly guided without being caught by the projected portion.

Further, the cross-sectional outer shapes of the portions-to-be-urged 26*c*L and 226*c*R and the corresponding accommodating portions 16L and 116R are not limited to the arcuate shape, but may also be other shapes so long as projected and recessed shapes by which the effect of the present invention can be obtained are formed. For example, the cross-sectional outer shape may also be a triangular shape or a rectangular shape, so that the similar effect can be obtained.

The above constitution is summarized as follows. To the apparatus main assembly A, the two or more species of the cartridges B and C different in volume of the toner accommodated at an initial stage are selectively mountable. These cartridges B and C include the different side members 26R and 226R, respectively, at one longitudinal end portion thereof. Further, the member 13 includes the urging portion 15R provided corresponding to each of the portion-to-be-urged 26*c*R and 226*c*R provided on the different side members 26R and 226R, respectively.

Further, this embodiment is also applicable to the developing cartridge including the developing roller and the apparatus main assembly to which the developing cartridge is detachably mountable, so that the similar effect can be obtained. Further, this embodiment is also applicable to the toner cartridge accommodating the toner and the apparatus main assembly to which the toner cartridge is detachably mountable, so that the similar effect can be obtained.

As described above in Embodiments 1 and 2, when the cartridge is exchanged and subjected to maintenance check, even when the cartridge is not mounted in the normal position due to erroneous mounting by the user, the cartridge can be finally mounted in the normal position. That is, with the operation of closing the openable member, the cartridge is pushed into the image forming apparatus main assembly by the urging portion to be moved to the normal position.

Further, at the time of completion of the mounting of the cartridge, the urging portion and the portion-to-be-urged are engaged with each other with the spacing. For that reason, when the cartridge is the process cartridge, the developing device unit is positioned relative to only the cleaning unit, so that the good image can be obtained without hindering the setting of the developing device unit during the image formation.

Further, at the same time, the present invention can alleviate the impact during transportation on the cartridge mounted in the image forming apparatus main assembly in the case where the cartridge packing type together with the main assembly during shipping of the image forming apparatus is employed. As a result, at the time when the image forming apparatus is delivered to the user, various settings of the cartridge at the time of factory shipping can be properly maintained, so that the good image can be obtained during the image formation.

Further, it is possible to alleviate the impact on the cartridge during the transportation without providing the cushioning member such as styrene foam in the spacing between the image forming apparatus main assembly and the cartridge. Therefore, when the image forming apparatus is delivered to the user and then is used, it is possible to reduce a step of opening the openable member and removing the cushioning member, so that also a discarded material does not generate.

Further, the supporting portion provided inside the openable member has the supporting surface adjacent to the accommodating portion of the recess-shaped portion-to-be-urged. Therefore, when the cartridge is mounted on the openable member placed in the open state, the cartridge can be mounted at its lower surface on the supporting surface while being moved along the supporting surface of the supporting portion provided on the openable member. The cartridge mounted on the supporting surface can be easily guided into the image forming apparatus main assembly, so that usability can be improved.

Further, by the closing operation of the openable member, when the cartridge is urged toward the mounting portion of the image forming apparatus main assembly, the force for reducing the contact pressure between the cartridge and the guide generates. As a result, at the portion where the cartridge is supported inside the image forming apparatus main assembly, the friction resistance can be reduced. As a result, the pushing-in force of the cartridge is reduced, and thus the force necessary to perform the closing operation of the openable member is decreased, so that the usability can be improved.

Further, the vibration and the impact during the transportation are exerted on the cartridge packed with the image forming apparatus main assembly, so that there is a possibility that the developing device unit is rotated about the connecting member, but the urging portion and the portion-to-be-urged are connected with each other. Therefore, the rotation is suppressed, so that an occurrence of contact damage of the developing roller on the photosensitive drum and the like can be prevented. As a result, when the user uses the image forming apparatus, it is possible to obtain the good image.

Further, even in the case where the two or more cartridges different in toner volume are usable in the single image forming apparatus main assembly, the side member including the portion-to-be-urged can be used in common. As a result, the cartridges having the different toner volumes are not required to be prepared by adding a new side member, so that an increase in the number of components can be suppressed.

Further, by providing the side member including the portion-to-be-urged at each of the longitudinal end portions of the developing device unit, the cartridge can be stably urged, so that reliability of the mounting of the cartridge on the mounting portion can be improved.

Further, at the time of the completion of the cartridge, by the engagement between the urging portion and the portion-to-be-urged which are provided at each of the longitudinal end portions, the impact during the transportation on the cartridge mounted in the image forming apparatus main assembly in the case where the cartridge packing type together with the main assembly during the shipping of the image forming apparatus is employed can be further alleviated.

Further, in the case where the two or more cartridges different in toner volume are usable in the single image forming apparatus main assembly, the two or more cartridges includes different side members, respectively. The openable member includes the urging portion and the accommodating portion of the portion-to-be-urged which are provided corresponding to each of the side members at each of different positions with respect to the axial direction of the developing roller. As a result, even in the case where the size of the side member is required to be changed, the same effect as that in the above case can be obtained.

The case where the cartridges includes the different side members is, e.g., the case where due to the increase in toner volume, the second feeding member is needed in order to improve the stirring power. That is, the gear space for performing the drive transmission of the second feeding member is needed inside the side member, so that the commonality of the side member between the two or more cartridges cannot be achieved. Such a case is assumed.

[Other Embodiments]

1) Functions, materials, shapes and relative arrangements of constituent elements described in the above-mentioned embodiments are not intended that the scope of the present invention is limited thereto unless otherwise specified particularly.

2) In the present invention, the image forming apparatus is not limited to the electrophotographic image forming apparatuses described in the above-mentioned embodiments. The image forming apparatus may include image forming apparatuses for forming the image on the recording material by using other known image forming principles and systems such as an electrostatic recording process and a magnetic recording process.

3) The image forming apparatus of the present invention is not limited to the image forming apparatus to which the single cartridge is detachably mountable. The image forming apparatus may include an image forming apparatus for forming a color image by detachably mounting a plurality of cartridges, different in color or the like of toners, on predetermined mount portions, respectively.

4) The cartridge is not limited to the integral-type process cartridge in the above-mentioned embodiments. The cartridge may include a function-separation-type process cartridge including image forming process means actable on the image bearing member on which the image is to be formed, and a developing cartridge including the developing means for developing, with the developer, the latent image formed on the image bearing member on which the image is to be formed. Further, the cartridge may also include the toner cartridge and another unit which is detachably mountable to the image forming apparatus main assembly and which contributes to the image forming process for forming the image on the recording material.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 269057/2013 filed Dec. 26, 2013, which is hereby incorporated by reference.

What is claimed is:

1. An image forming apparatus for forming an image on a recording material, comprising:

a main assembly provided with an opening through which a cartridge is to be mounted into and demounted from said main assembly;

an openable member movable between a closed position where the opening is closed and an open position where the opening is open; and a cartridge, including a portion-to-be-urged, detachably mountable to said main assembly in a mounting completion position, wherein said openable member includes a guiding portion including a supporting surface, a recessed portion provided partway of the supporting surface, and an urging portion as a part of said supporting surface, wherein when said openable member is in the open position, said supporting surface is capable of guiding said cartridge to the opening, wherein during a closing operation of said openable member, said urging portion and said portion-to-be-urged contact each other to push said cartridge toward the mounting completion position, wherein when said openable member is in the closed position, a spacing is provided between said recessed portion and said portion-to-be-urged, and wherein said cartridge is a process cartridge comprising:

a photosensitive member unit including a photosensitive drum;

a developing device unit, including a developing roller for developing an electrostatic latent image formed on said photosensitive drum, rotatable relative to said photosensitive member unit; and an urging member for urging said developing roller toward said photosensitive drum, wherein said developing device unit includes said portion-to-be-urged.

2. An image forming apparatus according to claim 1, wherein said developing device unit includes a side member rotatably connected with said photosensitive member unit at one end portion of said developing device unit with respect to an axial direction of said developing roller, and wherein said side member includes said portion-to-be-urged.

3. An image forming apparatus according to claim 1, wherein said developing device unit includes a side member rotatably connected with said photosensitive member unit at each end portion of said developing device unit with respect to an axial direction of said developing roller, and wherein said side member includes said portion-to-be-urged.

4. An image forming apparatus for forming an image on a recording material, comprising:

a main assembly provided with an opening through which a cartridge is to be mounted into and demounted from said main assembly;

an openable member movable between a closed position where the opening is closed and an open position where the opening is open; and a cartridge, including a portion-to-be-urged, detachably mountable to said main assembly in a mounting completion position, wherein said openable member includes a guiding portion including a supporting surface, a recessed portion provided partway of said supporting surface, and an urging portion as a part of said supporting surface, wherein when said openable member is in the open position, said supporting surface is capable of guiding said cartridge to the opening, wherein during a closing operation of said openable member, said urging portion and said portion-to-be-urged contact each other to push said cartridge toward the mounting completion position, wherein when said openable member is in the closed position, a spacing is provided between said recessed portion and said portion-to-be-urged, wherein said cartridge is a developing cartridge including a developing roller for developing an electrostatic latent image formed on said photosensitive drum, wherein said developing cartridge includes a side member at one end portion with respect to an axial direction of said developing roller, and wherein said side member includes said portion-to-be-urged.

5. An image forming apparatus for forming an image on a recording material, comprising:

a main assembly provided with an opening through which a cartridge is to be mounted into and demounted from said main assembly;

an openable member movable between a closed position where the opening is closed and an open position where the opening is open; and a cartridge, including a portion-to-be-urged, detachably mountable to said main assembly in a mounting completion position, wherein said openable member includes a guiding portion including a supporting surface, a recessed portion provided partway of said supporting surface, and an urging portion as a part of said supporting surface, wherein when said openable member is in the open position, said supporting surface is capable of guiding said cartridge to the opening, wherein during a closing operation of said openable member, said urging portion and said portion-to-be-urged contact each other to push said cartridge toward the mounting completion position, wherein when said openable member is in the closed position, a spacing is provided between said recessed portion and said portion-to-be-urged, wherein said cartridge is a developing cartridge including a developing roller for developing an electrostatic latent image formed on said photosensitive drum, wherein said developing cartridge includes a side member at each end portion with respect to an axial direction of said developing roller, and wherein said side member includes said portion-to-be-urged.

6. An image forming apparatus for forming an image on a recording material, comprising:

a main assembly provided with an opening through which a cartridge is to be mounted into and demounted from said main assembly;

an openable member movable between a closed position where the opening is closed and an open position where the opening is open; and a cartridge, including a portion-to-be-urged, detachably mountable to said main assembly in a mounting completion position, wherein said openable member includes a guiding portion including a supporting surface, a recessed portion provided partway of said supporting surface, and an urging portion as a part of said supporting surface, wherein when said openable member is in the open position, said supporting surface is capable of guiding said cartridge to the opening, wherein during a closing operation of said openable member, said urging portion and said portion-to-be-urged contact each other to push said cartridge toward the mounting completion position, wherein when said openable member is in the closed position, a spacing is provided between said recessed portion and said portion-to-be-urged, and wherein said cartridge is a toner cartridge for accommodating a toner to be supplied to a developing device for developing an electrostatic latent image formed on a photosensitive drum.

7. An image forming apparatus according to claim 6, wherein said toner cartridge includes a side member at one end portion with respect to a longitudinal direction, and wherein said side member includes said portion-to-be-urged.

8. An image forming apparatus according to claim 6, wherein said toner cartridge includes a side member at each end portion with respect to a longitudinal direction, and wherein said side member includes said portion-to-be-urged.

9. A cartridge detachably mountable to an image forming apparatus for forming an image on a recording material in a mounting completion position, said image forming apparatus comprising:

a main assembly provided with an opening through which said cartridge is to be mounted into and demounted from said main assembly;

an openable member movable between a closed position where the opening is closed and an open position where the opening is open, said openable member including a recessed portion and an urging portion; and a cartridge, wherein said cartridge is a process cartridge comprising, a photosensitive member unit including a photosensitive drum, a developing device unit, including a developing roller for developing an electrostatic latent image formed on said photosensitive drum, rotatable relative to said photosensitive member unit, and an urging member for urging said developing roller toward said photosensitive drum, wherein said developing device unit includes a portion-to-be-urged, wherein during a closing operation of said openable member, said portion-to-be-urged and said urging portion contact each other to push said cartridge toward the mounting completion position, and wherein when said openable member is in the closed position, a spacing is provided between said portion-to-be-urged and said recessed portion.

10. A cartridge according to claim 9, wherein said developing device unit includes a side member rotatably connected with said photosensitive member unit at one end portion of said developing device unit with respect to an axial direction of said developing roller, and wherein said side member includes said portion-to-be-urged.

11. A cartridge according to claim 10, wherein said developing device unit includes a side member rotatably connected with said photosensitive member unit at each end portion of said developing device unit with respect to an axial direction of said developing roller, and wherein said side member includes said portion-to-be-urged.

12. A cartridge detachably mountable to an image forming apparatus for forming an image on a recording material in a mounting completion position, said image forming apparatus comprising:

a main assembly provided with an opening through which said cartridge is to be mounted into and demounted from said main assembly;

an openable member movable between a closed position where the opening is closed and an open position where the opening is open, said openable member including a recessed portion and an urging portion; and a cartridge, wherein said cartridge is a developing cartridge including a developing roller for developing an electrostatic latent image formed on a photosensitive drum, and a portion-to-be-urged, detachably mountable to said main assembly in a mounting completion position, wherein during a closing operation of said openable member, said portion-to-be-urged and said urging portion contact each other to push said cartridge toward the mounting completion position, wherein when said openable member is in the closed position, a spacing is provided between said portion-to-be-urged and said recessed portion, wherein said developing cartridge further includes a side member at one end portion with respect to an axial direction of said developing roller, and wherein said side member includes said portion-to-be-urged.

13. A cartridge detachably mountable to an image forming apparatus for forming an image on a recording material in a mounting completion position, said image forming apparatus comprising:

a main assembly provided with an opening through which said cartridge is to be mounted into and demounted from said main assembly;

an openable member movable between a closed position where the opening is closed and an open position where the opening is open, said openable member including a recessed portion and an urging portion; and a cartridge, wherein said cartridge is a developing cartridge including a developing roller for developing an electrostatic latent image formed on a photosensitive drum, and a portion-to-be-urged, detachably mountable to said main assembly in a mounting completion position, wherein during a closing operation of said openable member, said portion-to-be-urged and said urging portion contact each other to push said cartridge toward the mounting completion position, wherein when said openable member is in the closed position, a spacing is provided between said portion-to-be-urged and said recessed portion, wherein said developing cartridge further includes a side member at each end portion with respect to an axial direction of said developing roller, and wherein said side member includes said portion-to-be-urged.

14. A cartridge detachably mountable to an image forming apparatus for forming an image on a recording material, said image forming apparatus comprising:

a main assembly provided with an opening through which a cartridge is to be mounted into and demounted from said main assembly;

an openable member movable between a closed position where the opening is closed and an open position where the opening is open, said openable member including a recessed portion and an urging portion; and a cartridge, wherein said cartridge includes a portion-to-be-urged, detachably mountable to said main assembly in a mounting completion position, and is a toner cartridge for accommodating a toner to be supplied to a developing device for developing an electrostatic latent image formed on a photosensitive drum, wherein during a closing operation of said openable member, said portion-to-be-urged and said urging portion contact each other to push said cartridge toward the mounting completion position, and wherein when said openable member is in the closed position, a spacing is provided between the portion-to-be-urged and said recessed portion.

15. An image forming apparatus according to claim 14, wherein said toner cartridge includes a side member at one end portion with respect to a longitudinal direction, and wherein said side member includes said portion-to-be-urged.

16. An image forming apparatus according to claim 14, wherein said toner cartridge includes a side member at each end portion with respect to a longitudinal direction, and wherein said side member includes said portion-to-be-urged.

* * * * *